US009626826B2

(12) United States Patent
Nguyen

(10) Patent No.: US 9,626,826 B2
(45) Date of Patent: Apr. 18, 2017

(54) LOCATION-BASED REAL-TIME CASINO DATA

(75) Inventor: Binh T. Nguyen, Reno, NV (US)

(73) Assignee: Nguyen Gaming LLC, Reno, NV (US)

( * ) Notice: Subject to any disclaimer, the term of this patent is extended or adjusted under 35 U.S.C. 154(b) by 0 days.

(21) Appl. No.: 12/797,610

(22) Filed: Jun. 10, 2010

(65) Prior Publication Data

US 2011/0306400 A1 Dec. 15, 2011

(51) Int. Cl.
*G07F 17/32* (2006.01)
*G07F 17/34* (2006.01)

(52) U.S. Cl.
CPC ..... *G07F 17/3218* (2013.01); *G07F 17/323* (2013.01); *G07F 17/3223* (2013.01); *G07F 17/3225* (2013.01); *G07F 17/3206* (2013.01); *G07F 17/3255* (2013.01); *G07F 17/34* (2013.01)

(58) Field of Classification Search
CPC ..... G07F 17/323; G07F 17/3225; G07F 17/3218; G07F 17/3223; G07F 17/34
USPC ..... 463/42, 29, 46, 47
See application file for complete search history.

(56) References Cited

U.S. PATENT DOCUMENTS

| | | | |
|---|---|---|---|
| 2,033,638 | A | 3/1936 | Koppl |
| 2,062,923 | A | 12/1936 | Nagy |
| 4,741,539 | A | 5/1988 | Sutton et al. |
| 4,948,138 | A | 8/1990 | Pease et al. |
| 5,067,712 | A | 11/1991 | Georgilas |
| 5,429,361 | A | 7/1995 | Raven et al. |
| 5,489,103 | A | 2/1996 | Okamoto |
| 5,630,757 | A | 5/1997 | Gagin |
| 5,655,961 | A | 8/1997 | Acres et al. |
| 5,704,835 | A | 1/1998 | Dietz, II |
| 5,727,786 | A | 3/1998 | Weingardt |
| 5,833,537 | A | 11/1998 | Barrie |
| 5,919,091 | A | 7/1999 | Bell et al. |
| 5,947,820 | A | 9/1999 | Morro et al. |
| 5,997,401 | A | 12/1999 | Crawford |
| 6,001,016 | A | 12/1999 | Walker et al. |
| 6,039,648 | A | 3/2000 | Guinn et al. |
| 6,059,289 | A | 5/2000 | Vancura |
| 6,089,977 | A | 7/2000 | Bennett |
| 6,095,920 | A | 8/2000 | Sudahiro |

(Continued)

FOREIGN PATENT DOCUMENTS

| | | |
|---|---|---|
| GB | 2033638 | 5/1980 |
| GB | 2062923 | 5/1981 |

(Continued)

OTHER PUBLICATIONS

Amanda Finnegan, Casinos Connecting with Customers via iPhone Apps, May 27, 2010, Las Vegas Sun, Las Vegas, NV, USA.

(Continued)

*Primary Examiner* — William H McCulloch, Jr.

(57) ABSTRACT

An apparatus, method, and system to acquire and display casino data on a portable electronic device may include a portable electronic device having a processor operative with a real-time location based data application to transmit the location of the portable electronic device and acquire, prioritize, store and display real-time casino data. The real-time casino data may be periodically updated based on the location of the portable electronic device and visually presented to a user on a display of the portable electronic device.

29 Claims, 13 Drawing Sheets

(56) References Cited

U.S. PATENT DOCUMENTS 6,110,041 A 8/2000 Walker et al.
6,142,872 A 11/2000 Walker et al.
6,146,273 A 11/2000 Olsen
6,165,071 A 12/2000 Weiss
6,231,445 B1 5/2001 Acres
6,270,412 B1 8/2001 Crawford et al.
6,290,600 B1 9/2001 Glasson
6,293,866 B1 9/2001 Walker et al.
6,353,390 B1 3/2002 Beri et al.
6,364,768 B1 4/2002 Acres et al.
6,404,884 B1 6/2002 Marwell et al.
6,416,406 B1 7/2002 Duhamel
6,416,409 B1 7/2002 Jordan
6,443,452 B1 9/2002 Brune
6,491,584 B2 12/2002 Graham et al.
6,505,095 B1 1/2003 Kolls
6,508,710 B1 1/2003 Paravia et al.
6,561,900 B1 5/2003 Baerlocker et al.
6,592,457 B1 7/2003 Frohm et al.
6,612,574 B1 9/2003 Cole et al.
6,620,046 B2 9/2003 Rowe
6,641,477 B1 11/2003 Dietz, II
6,645,078 B1 11/2003 Mattice
6,719,630 B1 4/2004 Seelig et al.
6,749,510 B2 6/2004 Globbi
6,758,757 B2 7/2004 Luciano, Jr. et al.
6,773,345 B2 8/2004 Walker et al.
6,778,820 B2 8/2004 Tendler
6,780,111 B2 8/2004 Cannon et al.
6,799,032 B2 9/2004 McDonnell et al.
6,800,027 B2 10/2004 Giobbi et al.
6,804,763 B1 10/2004 Stockdate et al.
6,811,486 B1 11/2004 Luciano, Jr.
6,843,725 B2 1/2005 Nelson
6,846,238 B2 1/2005 Wells
6,848,995 B1 2/2005 Walker et al.
6,852,029 B2 2/2005 Baltz et al.
6,869,361 B2 3/2005 Sharpless et al.
6,875,106 B2 4/2005 Weiss et al.
6,884,170 B2 4/2005 Rowe
6,884,172 B1 4/2005 Lloyd et al.
6,902,484 B2 6/2005 Idaka
6,908,390 B2 6/2005 Nguyen et al.
6,913,532 B2 7/2005 Bearlocher et al.
6,923,721 B2 8/2005 Luciano et al.
6,935,958 B2 8/2005 Nelson
6,949,022 B1 9/2005 Showers et al.
6,955,600 B2 10/2005 Glavich et al.
6,971,956 B2 12/2005 Rowe et al.
6,984,174 B2 1/2006 Cannon et al.
6,997,803 B2 2/2006 LeMay et al.
7,018,292 B2 3/2006 Tracy et al.
7,032,115 B2 4/2006 Kashani
7,033,276 B2 4/2006 Walker et al.
7,035,626 B1 4/2006 Luciano, Jr.
7,037,195 B2 5/2006 Schneider et al.
7,048,628 B2 5/2006 Schneider
7,048,630 B2 5/2006 Berg et al.
7,063,617 B2 6/2006 Brosnan et al.
7,076,329 B1 7/2006 Kolls
7,089,264 B1 8/2006 Guido et al.
7,094,148 B2 8/2006 Baerlocher et al.
7,105,736 B2 9/2006 Laakso
7,111,141 B2 9/2006 Nelson
7,144,321 B2 12/2006 Mayeroff
7,152,783 B2 12/2006 Charrin
7,169,041 B2 1/2007 Tessmer et al.
7,169,052 B2 1/2007 Beaulieu et al.
7,175,523 B2 2/2007 Gilmore et al.
7,181,228 B2 2/2007 Boesch
7,182,690 B2 2/2007 Giobbi et al.
RE39,644 E 5/2007 Alcorn et al.
7,243,104 B2 7/2007 Bill
7,247,098 B1 7/2007 Bradford et al.
7,259,718 B2 8/2007 Patterson et al.
7,275,989 B2 10/2007 Moody
7,285,047 B2 10/2007 Gielb et al.
7,314,408 B2 1/2008 Cannon et al.
7,316,615 B2 1/2008 Soltys et al.
7,316,619 B2 1/2008 Nelson
7,318,775 B2 1/2008 Brosnan et al.
7,326,116 B2 2/2008 O'Donovan et al.
7,330,108 B2 2/2008 Thomas
7,346,358 B2 3/2008 Wood et al.
7,355,112 B2 4/2008 Laakso
7,384,338 B2 6/2008 Rothschild et al.
7,387,571 B2 6/2008 Walker et al.
7,393,278 B2 7/2008 Gerson et al.
7,396,990 B2 7/2008 Lu et al.
7,415,426 B2 8/2008 Williams et al.
7,425,177 B2 9/2008 Rodgers et al.
7,427,234 B2 9/2008 Soltys et al.
7,427,236 B2 9/2008 Kaminkow et al.
7,427,708 B2 9/2008 Ohmura
7,431,650 B2 * 10/2008 Kessman ..... G06Q 10/1097 463/13
7,448,949 B2 11/2008 Kaminkow et al.
7,500,913 B2 3/2009 Baerlocher
7,510,474 B2 3/2009 Carter, Sr.
7,513,828 B2 4/2009 Nguyen et al.
7,519,838 B1 4/2009 Suurballe
7,559,838 B2 7/2009 Walker et al.
7,563,167 B2 * 7/2009 Walker et al. ..... 463/25
7,572,183 B2 8/2009 Olivas et al.
7,585,222 B2 9/2009 Muir
7,602,298 B2 10/2009 Thomas
7,607,174 B1 10/2009 Kashchenko et al.
7,611,409 B2 11/2009 Muir et al.
7,637,810 B2 12/2009 Amaitis et al.
7,644,861 B2 1/2010 Alderucci et al.
7,653,757 B1 1/2010 Fernald et al.
7,693,306 B2 4/2010 Huber
7,699,703 B2 4/2010 Muir et al.
7,722,453 B2 5/2010 Lark et al.
7,758,423 B2 7/2010 Foster et al.
7,771,271 B2 8/2010 Walker et al.
7,780,529 B2 8/2010 Rowe et al.
7,780,531 B2 8/2010 Englman et al.
7,785,192 B2 8/2010 Canterbury et al.
7,811,172 B2 10/2010 Asher et al.
7,819,749 B1 10/2010 Fish
7,822,688 B2 10/2010 Labron
7,828,652 B2 11/2010 Nguyen et al.
7,828,654 B2 11/2010 Carter, Sr.
7,828,661 B1 11/2010 Fish
7,850,528 B2 12/2010 Wells
7,874,919 B2 1/2011 Paulsen et al.
7,877,798 B2 1/2011 Saunders et al.
7,883,413 B2 2/2011 Paulsen
7,892,097 B2 * 2/2011 Muir et al. ..... 463/42
7,909,692 B2 * 3/2011 Nguyen et al. ..... 463/22
7,909,699 B2 3/2011 Parrott et al.
7,918,728 B2 * 4/2011 Nguyen et al. ..... 463/29
7,927,211 B2 * 4/2011 Rowe et al. ..... 463/29
7,927,212 B2 4/2011 Hedrick et al.
7,951,008 B2 5/2011 Wolf et al.
8,057,298 B2 11/2011 Nguyen et al.
8,057,303 B2 11/2011 Rasmussen
8,087,988 B2 * 1/2012 Nguyen et al. ..... 463/17
8,117,608 B1 2/2012 Slettehaugh et al.
8,133,113 B2 3/2012 Nguyen
8,182,326 B2 * 5/2012 Speer et al. ..... 463/16
8,210,927 B2 * 7/2012 Hedrick ..... G07F 17/0014 463/25
8,226,459 B2 7/2012 Barrett
8,226,474 B2 * 7/2012 Nguyen et al. ..... 463/29
8,231,456 B2 7/2012 Zielinski
8,235,803 B2 8/2012 Loose et al.
8,282,475 B2 * 10/2012 Nguyen et al. ..... 463/29
8,323,099 B2 * 12/2012 Durham et al. ..... 463/25
8,337,290 B2 12/2012 Nguyen et al.
8,393,948 B2 3/2013 Allen et al.
8,403,758 B2 3/2013 Hornik et al.
8,430,745 B2 4/2013 Agarwal et al.

(56) References Cited

U.S. PATENT DOCUMENTS 8,461,958 B2 6/2013 Saenz
8,469,813 B2 * 6/2013 Joshi ..... G06Q 30/0257 463/12
8,529,345 B2 9/2013 Nguyen
8,613,655 B2 12/2013 Kisenwether et al.
8,613,659 B2 12/2013 Nelson et al.
8,696,470 B2 * 4/2014 Nguyen ..... G06Q 30/02 463/43
8,745,417 B2 6/2014 Huang et al.
8,858,323 B2 * 10/2014 Nguyen et al. ..... 463/29
8,864,586 B2 10/2014 Nguyen
8,942,995 B1 1/2015 Kerr
9,039,507 B2 5/2015 Allen et al.
9,235,952 B2 1/2016 Nguyen
9,325,203 B2 4/2016 Nguyen
9,486,697 B2 11/2016 Nguyen
9,486,704 B2 11/2016 Nguyen
2001/0016516 A1 8/2001 Takatsuka
2001/0024971 A1 9/2001 Brossard
2002/0006822 A1 1/2002 Krintzman
2002/0042295 A1 4/2002 Walker et al.
2002/0111210 A1 8/2002 Luciano, Jr. et al.
2002/0111213 A1 * 8/2002 McEntee et al. ..... 463/42
2002/0113369 A1 8/2002 Weingardt
2002/0116615 A1 * 8/2002 Nguyen et al. ..... 713/168
2002/0133418 A1 * 9/2002 Hammond et al. ..... 705/26
2002/0137217 A1 9/2002 Rowe et al.
2002/0142825 A1 10/2002 Lark et al.
2002/0147047 A1 10/2002 Letovsky et al.
2002/0147049 A1 * 10/2002 Carter, Sr. ..... 463/42
2002/0151366 A1 10/2002 Walker et al.
2002/0167536 A1 * 11/2002 Valdes et al. ..... 345/633
2002/0183105 A1 12/2002 Cannon et al.
2003/0001338 A1 1/2003 Bennett et al.
2003/0008696 A1 1/2003 Abecassis et al.
2003/0027635 A1 2/2003 Walker et al.
2003/0064805 A1 * 4/2003 Wells ..... 463/39
2003/0064807 A1 4/2003 Walker et al.
2003/0092480 A1 5/2003 White et al.
2003/0100361 A1 5/2003 Sharpless et al.
2003/0104860 A1 6/2003 Cannon et al.
2003/0104865 A1 6/2003 Itkis et al.
2003/0148809 A1 8/2003 Nelson
2003/0162588 A1 8/2003 Brosnan et al.
2003/0195024 A1 10/2003 Slattery
2003/0199295 A1 10/2003 Vancura
2003/0224852 A1 12/2003 Walker et al.
2003/0224854 A1 12/2003 Joao
2004/0002386 A1 * 1/2004 Wolfe et al. ..... 463/42
2004/0005919 A1 1/2004 Walker et al.
2004/0023709 A1 2/2004 Beaulieu et al.
2004/0023716 A1 2/2004 Gauselmann
2004/0048650 A1 3/2004 Mierau et al.
2004/0068460 A1 * 4/2004 Feeley ..... G06Q 40/04 705/37
2004/0082385 A1 4/2004 Silva et al.
2004/0106449 A1 6/2004 Walker et al.
2004/0127277 A1 7/2004 Walker
2004/0127290 A1 7/2004 Walker et al.
2004/0137987 A1 * 7/2004 Nguyen et al. ..... 463/42
2004/0147308 A1 * 7/2004 Walker et al. ..... 463/25
2004/0152508 A1 8/2004 Lind
2004/0214622 A1 10/2004 Atkinson
2004/0224753 A1 11/2004 Odonovan et al.
2004/0256803 A1 12/2004 Ko
2004/0259633 A1 * 12/2004 Gentles et al. ..... 463/29
2005/0003890 A1 * 1/2005 Hedrick et al. ..... 463/29
2005/0004980 A1 * 1/2005 Vadjinia ..... 709/203
2005/0026696 A1 2/2005 Hashimoto et al.
2005/0054446 A1 3/2005 Kammler
2005/0101376 A1 5/2005 Walker et al.
2005/0101383 A1 * 5/2005 Wells ..... 463/39
2005/0130728 A1 6/2005 Nguyen et al.
2005/0137014 A1 6/2005 Vetelainen
2005/0181865 A1 8/2005 Luciano
2005/0181870 A1 * 8/2005 Nguyen et al. ..... 463/29
2005/0181875 A1 8/2005 Hoehne
2005/0187020 A1 8/2005 Amaitis et al.
2005/0202875 A1 9/2005 Murphy et al.
2005/0209002 A1 9/2005 Blythe et al.
2005/0221881 A1 10/2005 Lannert
2005/0223219 A1 10/2005 Gatto et al.
2005/0239546 A1 * 10/2005 Hedrick et al. ..... 463/29
2005/0273635 A1 12/2005 Wilcox et al.
2005/0277471 A1 12/2005 Russell et al.
2005/0282637 A1 12/2005 Gatto et al.
2006/0009283 A1 1/2006 Englman et al.
2006/0036874 A1 * 2/2006 Cockerille ..... G06F 21/52 713/187
2006/0046822 A1 3/2006 Kaminkow et al.
2006/0046830 A1 3/2006 Webb
2006/0046849 A1 3/2006 Kovacs
2006/0068893 A1 3/2006 Jaffe et al.
2006/0073869 A1 4/2006 LeMay et al.
2006/0073897 A1 4/2006 Englman et al.
2006/0148551 A1 7/2006 Walker et al.
2006/0189382 A1 * 8/2006 Muir et al. ..... 463/29
2006/0217193 A1 * 9/2006 Walker et al. ..... 463/29
2006/0247028 A1 11/2006 Brosnan et al.
2006/0247035 A1 11/2006 Rowe et al.
2006/0252530 A1 11/2006 Oberberger et al.
2006/0253481 A1 11/2006 Guido et al.
2006/0281525 A1 12/2006 Borissov
2006/0281541 A1 12/2006 Nguyen et al.
2006/0287106 A1 12/2006 Jensen
2007/0004510 A1 1/2007 Underdahl et al.
2007/0026935 A1 2/2007 Wolf et al.
2007/0026942 A1 2/2007 Kinsley
2007/0054739 A1 3/2007 Amaitis et al.
2007/0060254 A1 3/2007 Muir
2007/0060306 A1 3/2007 Amaitis et al.
2007/0060319 A1 3/2007 Block et al.
2007/0060358 A1 3/2007 Amaitas et al.
2007/0077981 A1 4/2007 Hungate et al.
2007/0087833 A1 4/2007 Feeney et al.
2007/0087834 A1 4/2007 Moser et al.
2007/0129123 A1 6/2007 Eryou et al.
2007/0149279 A1 6/2007 Norden et al.
2007/0149286 A1 6/2007 Bemmel
2007/0159301 A1 7/2007 Brown
2007/0161402 A1 7/2007 Ng et al.
2007/0184896 A1 8/2007 Dickerson
2007/0184904 A1 8/2007 Lee
2007/0191109 A1 8/2007 Crowder et al.
2007/0207852 A1 9/2007 Nelson et al.
2007/0207854 A1 9/2007 Wolf et al.
2007/0238505 A1 10/2007 Okada
2007/0241187 A1 * 10/2007 Alderucci et al. ..... 235/382
2007/0248036 A1 10/2007 Nevalainen
2007/0257430 A1 11/2007 Hardy et al.
2007/0259713 A1 11/2007 Fiden et al.
2007/0259717 A1 11/2007 Mattice et al.
2007/0270213 A1 11/2007 Nguyen et al.
2007/0275777 A1 11/2007 Walker et al.
2007/0275779 A1 11/2007 Amaitis et al.
2007/0281782 A1 12/2007 Amaitis et al.
2007/0281785 A1 12/2007 Amaitis et al.
2007/0298873 A1 12/2007 Nguyen et al.
2008/0015032 A1 1/2008 Bradford et al.
2008/0020824 A1 1/2008 Cuddy et al.
2008/0032787 A1 2/2008 Low et al.
2008/0058105 A1 * 3/2008 Combs et al. ..... 463/42
2008/0070652 A1 3/2008 Nguyen et al.
2008/0070681 A1 3/2008 Marks et al.
2008/0076506 A1 3/2008 Nguyen et al.
2008/0076548 A1 3/2008 Paulsen
2008/0076572 A1 3/2008 Nguyen et al.
2008/0096650 A1 4/2008 Baerlocher
2008/0102956 A1 * 5/2008 Burman et al. ..... 463/42
2008/0102957 A1 5/2008 Burnman et al.
2008/0119267 A1 * 5/2008 Denlay ..... 463/29
2008/0146321 A1 6/2008 Parente
2008/0150902 A1 6/2008 Edpalm et al.
2008/0153583 A1 6/2008 Huntley et al.

(56) References Cited

U.S. PATENT DOCUMENTS

2008/0161110 A1 7/2008 Campbell
2008/0167106 A1 7/2008 Lutnick et al.
2008/0182667 A1* 7/2008 Davis et al. ..... 463/43
2008/0207307 A1 8/2008 Cunningham, II et al.
2008/0214258 A1 9/2008 Brosnan et al.
2008/0215319 A1 9/2008 Lu
2008/0234047 A1* 9/2008 Nguyen ..... 463/42
2008/0238610 A1 10/2008 Rosenbereg
2008/0248849 A1 10/2008 Lutnick
2008/0254878 A1 10/2008 Sauders et al.
2008/0254881 A1* 10/2008 Lutnick et al. ..... 463/31
2008/0254883 A1 10/2008 Patel et al.
2008/0254891 A1 10/2008 Sauders et al.
2008/0254892 A1 10/2008 Sauders et al.
2008/0254897 A1 10/2008 Sauders et al.
2008/0263173 A1 10/2008 Weber et al.
2008/0300058 A1 12/2008 Sum et al.
2008/0305864 A1 12/2008 Kelly et al.
2008/0305865 A1 12/2008 Kelly et al.
2008/0305866 A1 12/2008 Kelly et al.
2008/0311994 A1 12/2008 Amaitas et al.
2008/0318669 A1 12/2008 Buchholz
2008/0318686 A1 12/2008 Crowder et al.
2009/0005165 A1 1/2009 Arezina et al.
2009/0011822 A1 1/2009 Englman
2009/0029766 A1 1/2009 Lutnick et al.
2009/0054149 A1 2/2009 Brosnan et al.
2009/0077396 A1 3/2009 Tsai et al.
2009/0088258 A1 4/2009 Saunders et al.
2009/0098925 A1 4/2009 Gagner et al.
2009/0104977 A1 4/2009 Zielinski
2009/0104983 A1 4/2009 Okada
2009/0118002 A1* 5/2009 Lyons ..... G07F 17/32 463/29
2009/0118013 A1 5/2009 Finnimore et al.
2009/0118022 A1 5/2009 Lyons et al.
2009/0124366 A1 5/2009 Aoki et al.
2009/0124390 A1 5/2009 Seelig et al.
2009/0131151 A1 5/2009 Harris et al.
2009/0132163 A1 5/2009 Ashley et al.
2009/0137255 A1 5/2009 Ashley et al.
2009/0149245 A1 6/2009 Fabbri
2009/0149261 A1 6/2009 Chen et al.
2009/0153342 A1 6/2009 Thorn
2009/0156303 A1 6/2009 Kiely et al.
2009/0176578 A1 7/2009 Herrmann et al.
2009/0191962 A1 7/2009 Hardy et al.
2009/0197684 A1 8/2009 Arezina et al.
2009/0216547 A1 8/2009 Canora et al.
2009/0219901 A1 9/2009 Bull et al.
2009/0221342 A1 9/2009 Katz et al.
2009/0227302 A1 9/2009 Abe
2009/0239666 A1 9/2009 Hall et al.
2009/0264190 A1* 10/2009 Davis et al. ..... 463/26
2009/0271287 A1 10/2009 Halpern
2009/0275410 A1 11/2009 Kisenwether et al.
2009/0275411 A1 11/2009 Kisenwether et al.
2009/0282469 A1 11/2009 Lynch
2009/0298468 A1 12/2009 Hsu
2010/0004058 A1 1/2010 Acres
2010/0016069 A1 1/2010 Herrmann
2010/0056248 A1 3/2010 Acres
2010/0062833 A1* 3/2010 Mattice et al. ..... 463/24
2010/0062840 A1 3/2010 Herrmann et al.
2010/0079237 A1 4/2010 Falk
2010/0081501 A1 4/2010 Carpenter et al.
2010/0099499 A1 4/2010 Amaitis et al.
2010/0106612 A1 4/2010 Gupta
2010/0120486 A1 5/2010 DeWaal
2010/0124967 A1 5/2010 Lutnick et al.
2010/0130276 A1 5/2010 Fiden
2010/0160035 A1 6/2010 Herrmann
2010/0160043 A1 6/2010 Fujimoto et al.
2010/0178977 A1 7/2010 Kim et al.
2010/0197383 A1 8/2010 Rader et al.
2010/0197385 A1 8/2010 Aoki et al.
2010/0203955 A1* 8/2010 Sylla ..... 463/25
2010/0203963 A1 8/2010 Allen
2010/0227662 A1* 9/2010 Speer et al. ..... 463/16
2010/0227670 A1 9/2010 Arezina et al.
2010/0227687 A1* 9/2010 Speer et al. ..... 463/31
2010/0234091 A1 9/2010 Baerlocher et al.
2010/0279764 A1 11/2010 Allen et al.
2010/0323780 A1 12/2010 Acres
2010/0325703 A1 12/2010 Etchegoyen
2011/0009181 A1* 1/2011 Speer et al. ..... 463/20
2011/0039615 A1 2/2011 Acres
2011/0065492 A1 3/2011 Acres
2011/0111827 A1 5/2011 Nicely et al.
2011/0111843 A1 5/2011 Nicely et al.
2011/0111860 A1 5/2011 Nguyen
2011/0118010 A1 5/2011 Brune
2011/0212711 A1 9/2011 Scott
2011/0223993 A1 9/2011 Allen et al.
2011/0263318 A1 10/2011 Agarwal et al.
2011/0306400 A1* 12/2011 Nguyen ..... 463/20
2011/0306426 A1 12/2011 Novak et al.
2012/0015709 A1 1/2012 Bennett et al.
2012/0028703 A1 2/2012 Anderson et al.
2012/0034968 A1 2/2012 Watkins et al.
2012/0094769 A1* 4/2012 Nguyen et al. ..... 463/42
2012/0108319 A1 5/2012 Caputo et al.
2012/0122561 A1 5/2012 Hedrick
2012/0122567 A1* 5/2012 Gangadharan et al. ..... 463/29
2012/0122584 A1 5/2012 Nguyen
2012/0122590 A1 5/2012 Nguyen
2012/0172130 A1 7/2012 Acres
2012/0184362 A1 7/2012 Barclay et al.
2012/0184363 A1 7/2012 Barclay et al.
2012/0190426 A1 7/2012 Acres
2012/0194448 A1 8/2012 Rothkopf
2012/0208618 A1 8/2012 Frerking
2012/0322563 A1* 12/2012 Nguyen et al. ..... 463/42
2012/0330740 A1* 12/2012 Pennington et al. ..... 705/14.27
2013/0005453 A1* 1/2013 Nguyen et al. ..... 463/29
2013/0059650 A1 3/2013 Sylla et al.
2013/0065668 A1 3/2013 LeMay
2013/0103965 A1 4/2013 Golembeski
2013/0104193 A1 4/2013 Gatto et al.
2013/0132745 A1 5/2013 Schoening et al.
2013/0196756 A1* 8/2013 Nguyen ..... G07F 17/3206 463/29
2013/0196776 A1 8/2013 Nguyen
2013/0210513 A1 8/2013 Nguyen
2013/0210514 A1 8/2013 Nguyen
2013/0210530 A1 8/2013 Nguyen
2013/0225279 A1 8/2013 Patceg
2013/0252730 A1* 9/2013 Joshi ..... G06Q 30/0257 463/31
2013/0316808 A1 11/2013 Nelson
2014/0006129 A1 1/2014 Heath
2014/0057716 A1 2/2014 Massing et al.
2014/0094295 A1* 4/2014 Nguyen ..... 463/29
2014/0094316 A1 4/2014 Nguyen
2014/0121005 A1 5/2014 Nelson
2014/0179431 A1* 6/2014 Nguyen ..... 463/31
2014/0274309 A1 9/2014 Nguyen
2014/0274319 A1 9/2014 Nguyen
2014/0274320 A1 9/2014 Nguyen
2014/0274342 A1* 9/2014 Nguyen et al. ..... 463/25
2014/0274357 A1* 9/2014 Nguyen et al. ..... 463/29
2014/0274360 A1 9/2014 Nguyen
2014/0274367 A1* 9/2014 Nguyen ..... 463/29
2014/0274388 A1 9/2014 Nguyen
2015/0089595 A1 3/2015 Telles
2015/0133223 A1 5/2015 Carter

FOREIGN PATENT DOCUMENTS

GB 2096376 10/1982
GB 2097570 11/1982
GB 2335524 9/1999
PH 12005000454 5/2007
WO WO 2005073933 8/2005

(56) References Cited

FOREIGN PATENT DOCUMENTS

| | | |
|---|---|---|
| WO | WO 2008/027621 | 3/2008 |
| WO | WO 2009/026309 | 2/2009 |
| WO | WO 2009/062148 | 5/2009 |
| WO | WO2010002897 A1 | 1/2010 |
| WO | WO 2010/017252 A1 | 2/2010 |

OTHER PUBLICATIONS

Kitty Bean Yancy, Navigate Around Vegas with New iPhone Apps, Jun. 3, 2010, USA Today, USA.
Liz Benston, Harrah's Launches iPhone App; Caesars Bypasses Check-In, Jan. 8, 2010, Las Vegas Sun, Las Vegas, NV, USA.
CEM Staff, Getting Back in the Game: Geolocation Can Ensure Compliance with New iGaming Regulations, Whitepaper, Casino Entertainment Management Magazine, Jan. 5, 2011, Association of Gaming Equipment Manufacturer, USA.
Benston, Liz, "Harrahs Launches iPhone App; Caesars Bypasses Check-in," Las Vegas Sun, Las Vegas, NV. Jan. 8, 2010.
Hasan, Ragib, et al., "A Survey of Peer-to-Peer Storage Techniques for Distributed File Systems", National Center for Supercomputing Applications, Department of Computer Science, University of Ilinois at Urbana Champain, Jun. 27, 2005.
Jones, Trahern, "Telecon-equipped drones could revolutionize wireless market", azcentral.com, http://www.azcentral.com/business/news/articles/20130424telecom-equipped-drones-could-revolutionize-wireless-market.html, downloaded Jul. 2, 2013, 2 pages.
Yancey, Kitty Bean, "Navigate Around Vegas with New iPhone Apps", USA Today, Jun. 3, 2010.
iAPS, Daily Systems LLC, 2010.
U.S. Appl. No. 12/945,889, filed Nov. 14, 2010.
U.S. Appl. No. 13/622,702, filed Sep. 19, 2012.
U.S. Appl. No. 13/800,917, filed Mar. 13, 2013.
U.S. Appl. No. 13/296,182, filed Nov. 15, 2011.
U.S. Appl. No. 13/801,234, filed Mar. 13, 2013.
U.S. Appl. No. 13/801,171, filed Mar. 13, 2013.
U.S. Appl. No. 13/843,192, filed Mar. 15, 2013.
U.S. Appl. No. 13/843,087, filed Mar. 15, 2013.
U.S. Appl. No. 13/632,743, filed Oct. 1, 2012.
U.S. Appl. No. 13/632,828, filed Oct. 1, 2012.
U.S. Appl. No. 13/833,953, filed Mar. 15, 2013.
U.S. Appl. No. 12/619,672, filed Nov. 16, 2009.
U.S. Appl. No. 13/801,121, filed Mar. 13, 2013.
U.S. Appl. No. 12/581,115, filed Oct. 17, 2009.
U.S. Appl. No. 13/801,076, filed Mar. 13, 2013.
U.S. Appl. No. 13/617,717, filed Nov. 12, 2009.
U.S. Appl. No. 13/633,118, filed Oct. 1, 2012.
U.S. Appl. No. 12/797,610, filed Jun. 10, 2010.
U.S. Appl. No. 13/801,256, filed Mar. 13, 2013.
U.S. Appl. No. 12/757,968, filed Apr. 9, 2010.
U.S. Appl. No. 12/797,616, filed Jun. 10, 2010.
U.S. Appl. No. 13/557,063, filed Jul. 24, 2012.
U.S. Appl. No. 13/833,116, filed Mar. 15, 2013.
U.S. Appl. No. 13/801,271, filed Mar. 13, 2011.
Office Action for U.S. Appl. No. 12/945,888 dated Apr. 10, 2012.
Final Office Action for U.S. Appl. No. 12/945,888 dated Sep. 21, 2012.
Advisory Action for U.S. Appl. No. 12/945,888 dated Jan. 30, 2013.
Office Action for U.S. Appl. No. 12/581,115 dated Dec. 20, 2011.
Final Office Action for U.S. Appl. No. 12/581,115 dated Sep. 13, 2012.
Notice of Allowance for U.S. Appl. No. 12/581,115 dated May 24, 2013.
Office Action for U.S. Appl. No. 12/619,672 dated Dec. 20, 2011.
Final Office Action for U.S. Appl. No. 12/619,672 dated Nov. 6, 2012.
Office Action for U.S. Appl. No. 12/619,672 dated Mar. 7, 2013.
Office Action for U.S. Appl. No. 12/617,717 dated Oct. 4, 2011.
Office Action for U.S. Appl. No. 12/617,717 dated Apr. 4, 2012.
Advisory Action for U.S. Appl. No. 12/617,717 dated Jun. 12, 2011.
Office Action for U.S. Appl. No. 12/617,717 dated Jun. 17, 2013.
Office Action for U.S. Appl. No. 12/797,610 dated Dec. 8, 2011.
Final Office Action for U.S. Appl. No. 12/797,610 dated Jun. 6, 2012.
Office Action for U.S. Appl. No. 12/757,968, dated Apr. 25, 2013.
Office Action for U.S. Appl. No. 12/797,616 dated Mar. 15, 2012.
Final Office Action for U.S. Appl. No. 12/797,616 dated Oct. 13, 2012.
Office Action for U.S. Appl. No. 12/797,616 dated Feb. 13, 2013.
Final Office Action for U.S. Appl. No. 12/797,616 dated May 8, 2013.
Office Action for U.S. Appl. No. 13/296,182 dated Dec. 5, 2012.
Brochure, 5000 Ft. Inc., 1 page, Nov. 2010.
Frontier Fortune game, email notification, MGM Resorts Intl., Aug. 9, 2013.
"Getting Back in the Game: Geolocation Can Ensure Compliance with New iGaming Regulations", White Paper, Quova, Inc., 2010.
Notice of Allowance of U.S. Appl. No. 12/619,672, mailed Aug. 23, 2013.
Office Action for U.S. Appl. No. 13/633,118, mailed Sep. 20, 2013.
Office Action for U.S. Appl. No. 13/801,256, mailed Jul. 2, 2013.
Notice of Allowance for U.S. Appl. No. 12/619,672, mailed Oct. 3, 2013.
Office Action for U.S. Appl. No. 12/617,717, mailed Jun. 17, 2013.
Notice of Allowance for U.S. Appl. No. 12/757,968, mailed Dec. 18, 2013.
Office Action for U.S. Appl. No. 12/945,889, mailed Dec. 18, 2013.
Office Action for U.S. Appl. No. 13/632,828, mailed Jul. 30, 2013.
Restriction Requirement for U.S. Appl. No. 13/801,256, mailed Dec. 30, 2013.
Office Action for U.S. Appl. No. 13/801,171, mailed Dec. 26, 2013.
Office Action for U.S. Appl. No. 13/801,234, mailed Jan. 10, 2014.
Final Office Action for U.S. Appl. No. 13/296,182, mailed Feb. 12, 2014.
Office Action for U.S. Appl. No. 12/617,717, mailed Feb. 25, 2014.
Office Action for U.S. Appl. No. 13/801,076, mailed Mar. 28, 2014.
Final Office Action for U.S. Appl. No. 13/633,118, mailed Apr. 3, 2014.
Office Action for U.S. Appl. No. 13/843,192, mailed Apr. 3, 2014.
Office Action for U.S. Appl. No. 13/632,743, mailed Apr. 10, 2014.
Office Action for U.S. Appl. No. 13/801,121, mailed Apr. 11, 2014.
Final Office Action for U.S. Appl. No. 12/945,889, mailed Jun. 30, 2014.
Notice of Allowance for U.S. Appl. No. 12/617,717, mailed Jul. 14, 2014.
Office Action for U.S. Appl. No. 13/801,121, mailed Sep. 24, 2014.
Office Action for U.S. Appl. No. 13/801,171, mailed Sep. 22, 2014.
Office Action for U.S. Appl. No. 13/801,234, mailed Oct. 1, 2014.
Final Office Action for U.S. Appl. No. 13/843,192, mailed Oct. 21, 2014.
Office Action for U.S. Appl. No. 13/632,743, mailed Oct. 23, 2014.
Office Action for U.S. Appl. No. 12/945,889, mailed Oct. 23, 2014.
Office Action for U.S. Appl. No. 13/632,828, mailed Nov. 7, 2014.
Final Office Action for U.S. Appl. No. 12/945,889, mailed Feb. 12, 2015.
Final Office Action for U.S. Appl. No. 13/801,171, mailed Mar. 16, 2015.
Office Action for U.S. Appl. No. 13/833,116, mailed Mar. 15, 2015.
Office Action for U.S. Appl. No. 13/632,828, mailed Apr. 10, 2015.
Notice of Allowance for U.S. Appl. No. 12/757,968, mailed Oct. 11, 2013.
Final Office Action for U.S. Appl. No. 13/801,121, mailed Apr. 21, 2015.
Final Office Action for U.S. Appl. No. 13/557,063, mailed Apr. 28, 2015.
Office Action for U.S. Appl. No. 13/296,182, mailed Jun. 5, 2015.
Office Action for U.S. Appl. No. 13/843,192, mailed Mar. 15, 2013.
Office Action for U.S. Appl. No. 12/797,610, mailed Jul. 14, 2015.
Final Office Action for U.S. Appl. No. 13/833,953, mailed Jul. 17, 2015.
Notice of Allowance for U.S. Appl. No. 12/945,889, mailed Jul. 22, 2015.
Office Action for U.S. Appl. No. 12/797,616, mailed Aug. 10, 2015.

(56) References Cited

OTHER PUBLICATIONS

Final Office Action for U.S. Appl. No. 13/801,234, mailed Aug. 14, 2015.
Final Office Action for U.S. Appl. No. 13/833,116, mailed Sep. 24, 2015.
Office Action for U.S. Appl. No. 13/801,121, mailed Oct. 2, 2015.
Office Action for U.S. Appl. No. 14/017,150, mailed Oct. 7, 2015.
Office Action for U.S. Appl. No. 14/017,159, mailed Oct. 7, 2015.
Office Action for U.S. Appl. No. 13/801,271 mailed Oct. 19, 2015.
Office Action for U.S. Appl. No. 14/211,536 mailed Oct. 19, 2015.
Final Office Action for U.S. Appl. No. 13/632,828, mailed Oct. 22, 2015.
Office Action for U.S. Appl. No. 14/217,066, mailed Dec. 17, 2015.
Notice of Allowance for U.S. Appl. No. 13/557,063, mailed Dec. 23, 2015.
Final Office Action for U.S. Appl. No. 13/843,192, mailed Dec. 30, 2015.
Office Action for U.S. Appl. No. 13/801,076, mailed Jan. 11, 2016.
Office Action for U.S. Appl. No. 12/945,888, mailed Jan. 22, 2016.
Final Office Action for U.S. Appl. No. 12/797,616, mailed Jun. 12, 2016.
Office Action for U.S. Appl. No. 13/843,087, mailed Feb. 25, 2016.
Office Action for U.S. Appl. No. 13/800,917, mailed Feb. 25, 2016.
Advisory Action for U.S. Appl. No. 13/632,828, mailed Feb. 25, 2016.
Office Action for U.S. Appl. No. 13/801,234, mailed Mar. 8, 2016.
Office Action for U.S. Appl. No. 14/216,986, mailed Mar. 9, 2016.
Final Office Action for U.S. Appl. No. 13/801,271, mailed Mar. 11, 2016.
Office Action for U.S. Appl. No. 13/622,702, mailed Sep. 19, 2012.
Final Office Action for U.S. Appl. No. 13/633,118, mailed Mar. 24, 2016.
Final Office Action for U.S. Appl. No. 14/189,948, mailed Apr. 6, 2016.
Final Office Action for U.S. Appl. No. 12/797,610, mailed Apr. 21, 2016.
Final Office Action for U.S. Appl. No. 14/017,150, mailed Apr. 26, 2016.
Final Office Action for U.S. Appl. No. 13/801,121, mailed May 11, 2016.
Final Office Action for U.S. Appl. No. 14/017,159, mailed Jun. 6, 2016.
Office Action for U.S. Appl. No. 13/801,719, mailed Jun. 6, 2016.
Office Action for U.S. Appl. No. 13/843,192, mailed Jun. 9, 2016.
Final OA for U.S. Appl. No. 12/945,888, mailed Jun. 28, 2016.
Notice of Allowance for U.S. Appl. No. 13/833,953, mailed Jul. 6, 2016.
Final Office Action for U.S. Appl. No. 13/801,171, mailed May 21, 2014.
Final Office Action for U.S. Appl. No. 13/801,234, mailed May 22, 2014.
Office Action for U.S. Appl. No. 14/211,536, mailed Jul. 13, 2016.
Notice of Allowance for U.S. Appl. No. 13/801,076, mailed Jul. 11, 2016.
Office Action for U.S. Appl. No. 13/296,182, mailed Jul. 20, 2016.
Restriction Requirement for U.S. Appl. No. 13/296,182, mailed Oct. 12, 2012.
Advisory Action for U.S. Appl. No. 13/296,182, mailed May 8, 2014.
Office Action for U.S. Appl. No. 13/296,182, mailed Dec. 23, 2015.
Advisory Action for U.S. Appl. No. 13/843,192, mailed May 8, 2014.
Office Action for U.S. Appl. No. 14/217,066, mailed Dec. 22, 2016.
Final Office Action for U.S. Appl. No. 14/216,986, mailed Sep. 23, 2016.
Office Action for U.S. Appl. No. 14/017,159, mailed Sep. 23, 2016.
Office Action for U.S. Appl. No. 13/632,743, mailed Sep. 23, 2016.
Final Office Action for U.S. Appl. No. 13/801,234, mailed Oct. 14, 2016.
Final Office Action for U.S. Appl. No. 13/843,087, mailed Oct. 13, 2016.
Final Office Action for U.S. Appl. No. 13/622,702, mailed Oct. 13, 2016.
Office Action for U.S. Appl. No. 14/189,948, mailed Nov. 7, 2016.
Final Office Action for U.S. Appl. No. 14/211,536, mailed Mar. 14, 2014.
Notice of Allowance for U.S. Appl. No. 13/833,116, mailed Oct. 11, 2016.

* cited by examiner

LOCATION-BASED REAL-TIME CASINO DATA

FIELD OF THE INVENTION

The present invention relates to location based real-time casino data. More particularly, the present invention relates to acquiring and presenting the location based real-time casino data using a portable electronic device.

BACKGROUND OF THE INVENTION

Electronic gaming devices such as slot machines, videos poker machines, and keno machines account for almost 70% of the revenue generated by a casino. There are numerous gaming themes that are in casinos and in development. As these trends continue, players will be bombarded by a bewildering array of gaming choices. As casinos become larger and more crowed, locating desired games becomes more difficult and frustrating for individual players.

A primary objective of a casino is to entice players to play for longer time periods. A personalized gaming experience may compel players to extend gaming sessions. Making it easier for players to locate and access casino services will provide a more compelling and enjoyable casino experience. With the recent growth of technologies associated with wireless networks, software as a service, and personal electronic devices such as smart phones, mobile media devices, tablet computing devices, and the like, increasingly the portable electronic devices have become the main device for users to access information and services. Many of the information and services are based on the location of the users.

While software applications for handheld devices are beginning to surface for casino environments, these applications are mostly geared towards simple data access. Intelligent location-based and player-based data are non-existent as indoor-locationing technology is still in its infancy. Additionally, the locational precision that's required of an indoor-locationing system to pinpoint a device or a person, and the sheer number of wireless devices carried by people who are next each other in a confined space, cause the accuracy to plunge, while cost of the system to ascend. A simple and robust system, method, and apparatus to reliably deliver player-relevant data to mobile devices in the crowded, secured, highly regulated, casino environment is desired.

OVERVIEW

A system, method, and apparatus capable of acquiring, transmitting, and presenting location based real-time casino data is discussed. In one embodiment, a portable electronic device, comprising a processor configured to receive real-time casino data associated with the location of the portable electronic device, an indoor location identifying device configured to indicate a location of the portable electronic device, a software application operative with the processor and configured to transmit a location of the portable electronic device and receive real-time casino data, an authentication device configured to verify and grant data access privileges to the at least one portable electronic device's software application, and a display configured to present the real-time casino data.

A method for acquiring casino data on a portable electronic device comprising transmitting a location of the portable electronic device to a gaming device, authenticating and granting data access privileges to the portable electronic device's software application, receiving real-time casino data based on the location of the portable electronic device, and presenting the real-time casino data on a display of the portable electronic device.

A system for providing real-time casino data comprising at least one portable electronic device comprising a processor configured to receive real-time casino data associated with the location of the portable electronic device, an indoor location identifying device configured to indicate a location of the portable electronic device, a software application operative with the processor and configured to transmit a location of the portable electronic device and receive real-time casino data, an authentication device configured to verify and grant data access privileges to the at least one portable electronic device's software application, and a display configured to present the real-time casino data. The system for providing real-time casino data further comprises a gaming device configured to acquire the location of at least one portable electronic device and transmit the real-time casino data based on the location of the at least one portable electronic device to the at least one portable electronic device. The real-time casino data may further be based on the access privileges, preset personal preferences, or spontaneous personal preferences of the user.

The present invention provides other hardware configured to perform the methods of the invention, as well as software stored in a machine-readable medium (e.g., a tangible storage medium) to control devices to perform these methods. These and other features will be presented in more detail in the following detailed description of the invention and the associated figures.

BRIEF DESCRIPTION OF THE DRAWINGS

The accompanying drawings, which are incorporated into and constitute a part of this specification, illustrate one or more example embodiments and, together with the description of example embodiments, serve to explain the principles and implementations.

In the drawings.

DESCRIPTION OF EXAMPLE EMBODIMENTS

Embodiments are described herein in the context of a location-based real-time casino data system. The following detailed description is illustrative only and is not intended to be in any way limiting. Other embodiments will readily suggest themselves to such skilled persons having the benefit of this disclosure. Reference will now be made in detail to implementations as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with the present invention, the components, process steps, and/or data structures may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein.

Figure 1:
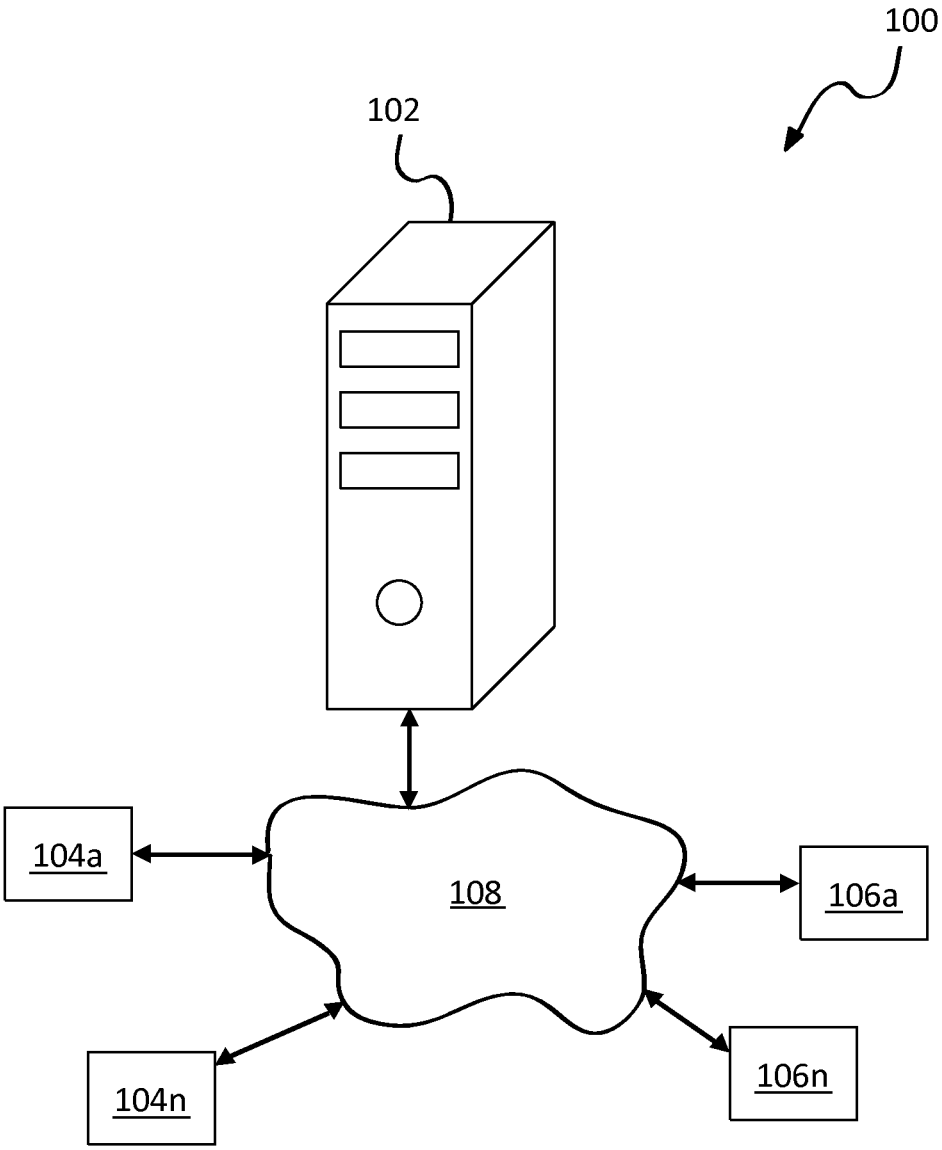
FIG. 1 illustrates a schematic diagram of a gaming system in accordance with one embodiment of the invention.

FIG. 1 illustrates a schematic diagram of a gaming system in accordance with one embodiment of the invention. The gaming system 100 comprises at least one gaming device 102, at least one portable electronic device 104*a*, 104*n*, at least one management portable electronic device 106*a*, 106*n* and a network 108. The network 108 can be accessible via any wired or wireless technology such as Bluetooth™, Wifi™, LTE, WiMax, Universal Serial Bus (USB), or Ethernet. The at least one gaming device 102 can be a gaming machine, for example a slot machine, a mobile device, a smart phone, a tablet computer, a game table, or a gaming server. The at least one gaming device 102 can be configured to periodically store and update real-time casino data. The at least one portable electronic device 104*a*, 104*n* can be configured to communicate with the at least one gaming device 102 via the network 108. The at least one management portable electronic device 106*a*, 106*n* can be configured to communicate with the at least one gaming device 102, as well as the at least one portable electronic device 104*a*, 104*n*, via the network 108. The client and management portable electronic devices 104*a*, 104*n*, 106*a*, and 106*n* can be configured to indicate each respective location and transmit its location to the gaming device 102. The client and management portable electronic devices 104*a*, 104*n*, 106*a*, and 106*n* can also acquire the real-time casino data from the at least one gaming device 102 as well as from each other (peer-to-peer manner) based on the location of each portable electronic device 104*a*, 104*n*, 106*a*, and 106*n*.

In another embodiment, the at least one gaming device 102 can be configured to detect the location of each portable electronic device 104*a*, 104*n*, 106*a*, and 106*n*, and transmit the real-time casino data to the at least one portable electronic device 104*a*, 104*n*, 106*a*, and 106*n* based on the location, access privilege, preset personal preference, spontaneous preference, etc., of the at least one portable electronic device 104*a*, 104*n*, 106*a*, and 106*n*. The at least one gaming device 102 can be configured to periodically receive and update the location of the at least one portable electronic device 104*a*, 104*n*, 106*a*, and 106*n*.

Figure 2:
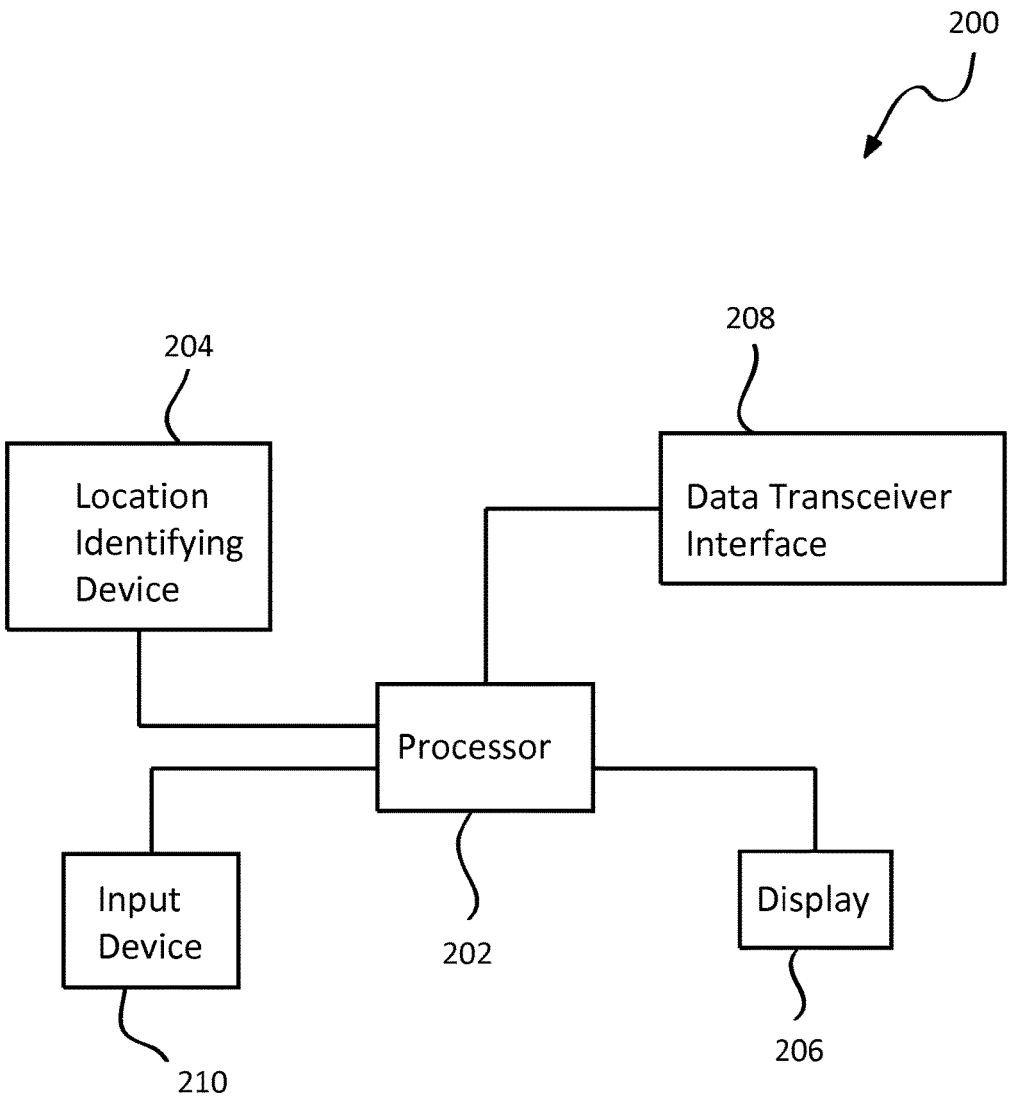
FIG. 2 illustrates a block diagram of a portable electronic in accordance with one embodiment of the invention.

FIG. 2 illustrates a block diagram of a portable electronic device 200 in accordance with one embodiment of the invention. The portable electronic device 200 can have a location-identifying device 204 configured to indicate a location of the portable electronic device when the portable electronic device is outdoors or indoors. In one embodiment, the location-identifying device 204 can include a location acquisition unit (hardware or software based) configured to acquire a location data of the portable electronic device, such as Cartesian coordinates within a casino establishment environment, latitude, longitude, distance, angle, orientation and the like.

For example, the location acquisition unit may acquire the location of the portable electronic device by using radio frequency (RF) wireless location tracking between the portable electronic device and at least one wireless access point distributed throughout the gaming establishment environment. In another example, an RF transceiver within the portable electronic device may be located by its position relative to the closest access point. In yet another example, triangulation or trilateration methods may be used in conjunction with multiple stationary access points to determine the location of the portable electronic device. RF fingerprinting location appliances, such as the Cisco Wireless Location Appliance™ manufactured by Cisco Systems, Inc. (San Jose, Calif., US), may be used to determine the location of the portable electronic device. RF fingerprinting may further refine the location data associated with the portable electronic device by comparing the live-captured RF characteristic of the current location of the portable electronic device to a known or predicted RF characteristic of a point or zone within the gaming establishment environment. In another example, location data may be determined visually by a plurality of smart cameras distributed throughout the gaming establishment environment. The smart cameras may recognize the portable electronic device by, for example, reading a 2D barcode displayed on the portable electronic device's display, and tracks its location and movement within the gaming establishment environment based on known location data of barcode reader, or nearby fixed objects. Using the portable electronic device to scan for nearby RF beacons and simply decodes their location is yet another method used when exact location is unnecessary.

The portable electronic device 200 can further comprise an authentication device configured to verify and authorize data access privileges of the portable electronic device 200's software application. In one embodiment, the authentication device can be a casino data access server configured to authenticate the software as well as verify and authorize access privileges of a software application. The portable electronic device 200 can transmit the user identifier code and the software application's digital signature information to a server for authentication and verification. When the portable electronic device transmits encrypted device identifier, user identifier, software digital signature, and other information to the server, the server is configured to decrypt the message and identifier information. The server then checks for correct values of the user identifier code, the software application's authenticity, and/or the device's identifier information.

The portable electronic device 200 further includes a processor 202 configured to receive real-time casino data associated with the location of the portable electronic device 200. The portable electronic device may further include a display 206 configured to present the real-time casino data. In one embodiment, the real-time casino data includes at least one gaming device data associated with the location of the portable electronic device 200. The gaming device maybe a slot machine, a table game, for example, blackjack, poker, craps, and the like, a mobile device, a smart phone, a computer, a tablet computer, and/or an interactive TV (iTV).

The portable electronic device 200 can also include at least one input device 210 configured to allow navigation of the real-time casino data. The input device 210 can include, but is not limited to, a plurality of buttons, a keyboard, a touch screen display, voice, gesture, and the like. The portable electronic device 200 can also include a data transceiver interface 208 configured to transmit data, including but not limited to, real-time casino data, authentication or verification data or both, and the like.

In one embodiment, the processor 202 can be configured to operate with the casino data application to receive real-time casino data associated with the location, access privileges, preferences, and/or spontaneous preferences of the portable electronic device 200. The casino data application may further organize and/or prioritize the real-time casino data according to the preferences of the player, of the casino, of a third-party sponsor of the application data, of the location of portable electronic device, or some combination of these. In another embodiment, the processor 202 can be configured to interact with a casino data center to receive real-time casino data associated with the location, access privileges, preset preferences, and/or spontaneous preference of the portable electronic device 200. The casino data application may further organize and/or prioritize the real-time casino data according to the preferences of the player, of the casino, of a third-party sponsor of the application data, of the location of portable electronic device, or some combination of these.

The casino data center can be configured to receive and store the gaming machine information transmitted from all gaming machines in the casino. The casino data center can also be configured to store data associated with the connection, history, operating states of hardware and software, and the session data with the portable electronic devices. Such a back-up storage capability helps in restoring an interrupted communication session between the casino data center and the portable electronic devices due to unforeseen events such as loss of battery power, loss of signals, corrupted memory, inadvertent delete, etc., on the portable electronic devices. In such a recovery process, the entire session is restored to the last known state (display, memory stack, communication, operating system, applications, data, history, input, output, etc.) on the portable electronic device using backup data from the casino data center. A new location data acquisition is performed. An opportunity to update the data, based on current location, is then offered to the user. Thus, the user is afforded an option to continue the previous session, or to start anew.

In yet another embodiment, the processor 202 can be configured to present a visual representation of a particular gaming zone on the display 206. A zone maybe a physical area or volume of the casino where one or more gaming devices or points of interest that share some common characteristics exist for at least a time period. For example, penny slots zone, high-limit gaming zone, poker zone, mystery bonus zone, and the like. In another illustrative example, the entire second floor of a casino can be a mystery bonus zone on Tuesdays. A zone may also be a virtual area/space where physically separated gaming devices maybe logically grouped for a common function or purpose, such as a slot tournament, group games, bonusing, progressives, and the like. Whether a zone is a physical location with gaming devices, or a logical group of gaming devices, a zone may have its own server dedicated to serving that zone and the gaming devices connected to it. The advantage of zone-based architecture is that the location services can be deployed in a piecemeal manner and scale up one zone at a time. Such a distributed architecture could be more desirable than a monolithic architecture of a property-wide location-based service. Another advantage is that the precise location of a device is not required once a portable electronic device is determined to be within a zone. As long as the portable electronic device is somewhere inside the zone, zone-based service and data can be provided. Precise location is no longer required, lowering the cost of a location tracking system.

In one embodiment, the visual representation includes at least one indicator configured to identify at least one gaming machine based on at least one criterion, such as an access privilege. The indicator may be any visual representation such as an icon, a picture, a border around an object of interest, a descriptive text string, a visual pattern unique to the gaming machine or particular gaming zone, and the like. In one embodiment, the indicator is a semi-transparent object overlaying a region of interest in a background image. For example, a computer generated semi-transparent mask overlaying a small area of the casino floor, highlighting a slot machine that is currently unoccupied and available players. The visual representation can be a line map, or a video camera image of a casino floor, or a hybrid representation where the line map overlays a still or a video camera image, identifying at least one gaming machine. In another embodiment, Augmented Reality technology, where one or more computer generated indicators are superimposed over a live video camera image, could be implemented. In this case, the player points the portable electronic device (equipped with a camera) in the general direction of interest. The video stream is analyzed, recognized, annotated and displayed, live, on the portable electronic device. As the player moves around the casino floor, annotations of gaming machines or other points of interest are dynamically updated.

Figure 3A:
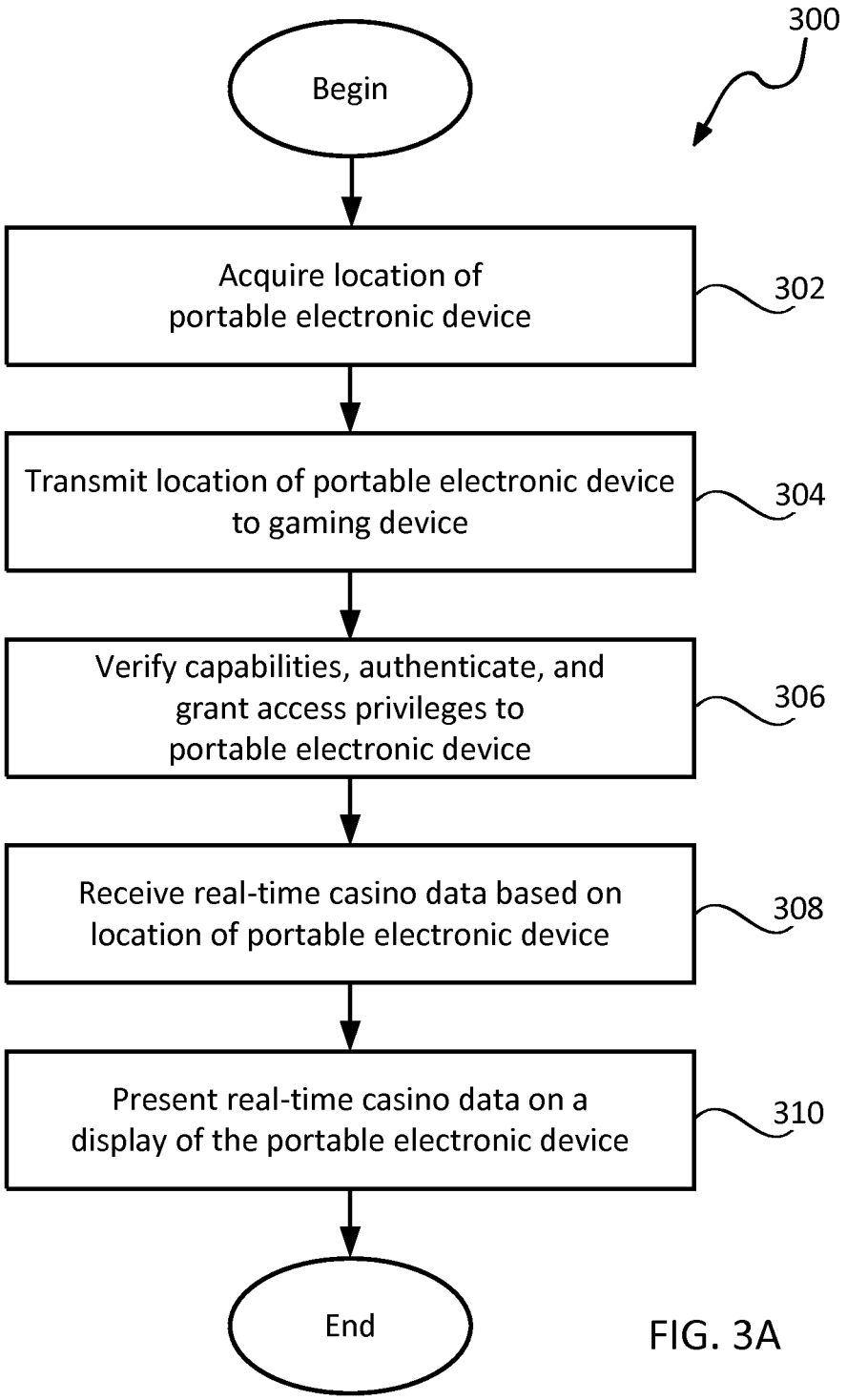
FIG. 3A illustrates a flow diagram of a method for acquiring real-time casino data.

FIG. 3A illustrates a flow diagram of a method for acquiring real-time casino data. A location of at least one portable electronic device can be calculated at 302. The location of the at least one portable electronic device can then be transmitted to a gaming device at 304, wherein the gaming device can be a slot machine, a central gaming server, or any other device. In one embodiment, the location of the portable electronic device can be associated with a predefined zone of the casino floor.

The method further includes verifying the capabilities, authenticating and granting data access privileges to the portable electronic device's software application at 306, receiving real-time casino data based on the location and capabilities of the portable electronic device at 308, and presenting the real-time casino data on a display of the at least one portable electronic device at 310. Capabilities of the portable electronic device include screen display size, screen resolution, computing capability, memory available, operating system type, software installed, and the like.

In one embodiment, the method further comprises periodically updating the location of the portable electronic device, transmitting an updated location of the portable electronic device to the gaming device; and receiving updated real-time casino data based on the updated location, preset preferences, spontaneous preferences, and access privileges of the portable electronic device.

In another embodiment, the presenting at 310 further comprises identifying at least one gaming machine that is generating revenue over a predetermined period of time. In yet another embodiment, the presenting further comprises displaying a visual representation of the predefined zone within the casino floor. Prior to presenting the real-time casino data on the display of the portable electronic device, the data may be organized and/or prioritized according to the preference of the user, of the casino, of a third-party sponsor of the application data, of the location of the portable electronic device, or some combination of these. In still another embodiment, the visual representation includes at least one indicator configured to identify at least one gaming machine based on at least one criterion. The visual representation can be a line map, or a video image of the casino floor, or a hybrid representation where the line map overlays a still or video camera image, identifying at least one gaming machine based on at least one criterion.

The real-time casino data may include gaming machine data. In one embodiment the gaming machine data includes pay-in data acquired over a predetermined period of time, pay-out data acquired over a predetermined period of time, game session duration data, or player entertainment preferences and play history. In another embodiment, the real-time casino data can be associated with the predefined zone of the casino floor. Real-time casino data acquisition maybe periodically updated and/or prioritized when a triggering event occurs, such as when the user moved to a different zone, at a predetermined time interval, when the user manually requests a data refresh, and the like. Using the acquired data, a casino manager may evaluate a player's value to the casino, and may award spontaneous perks such as cash back, bonus spins, food/drink vouchers, etc.

Figure 3B:
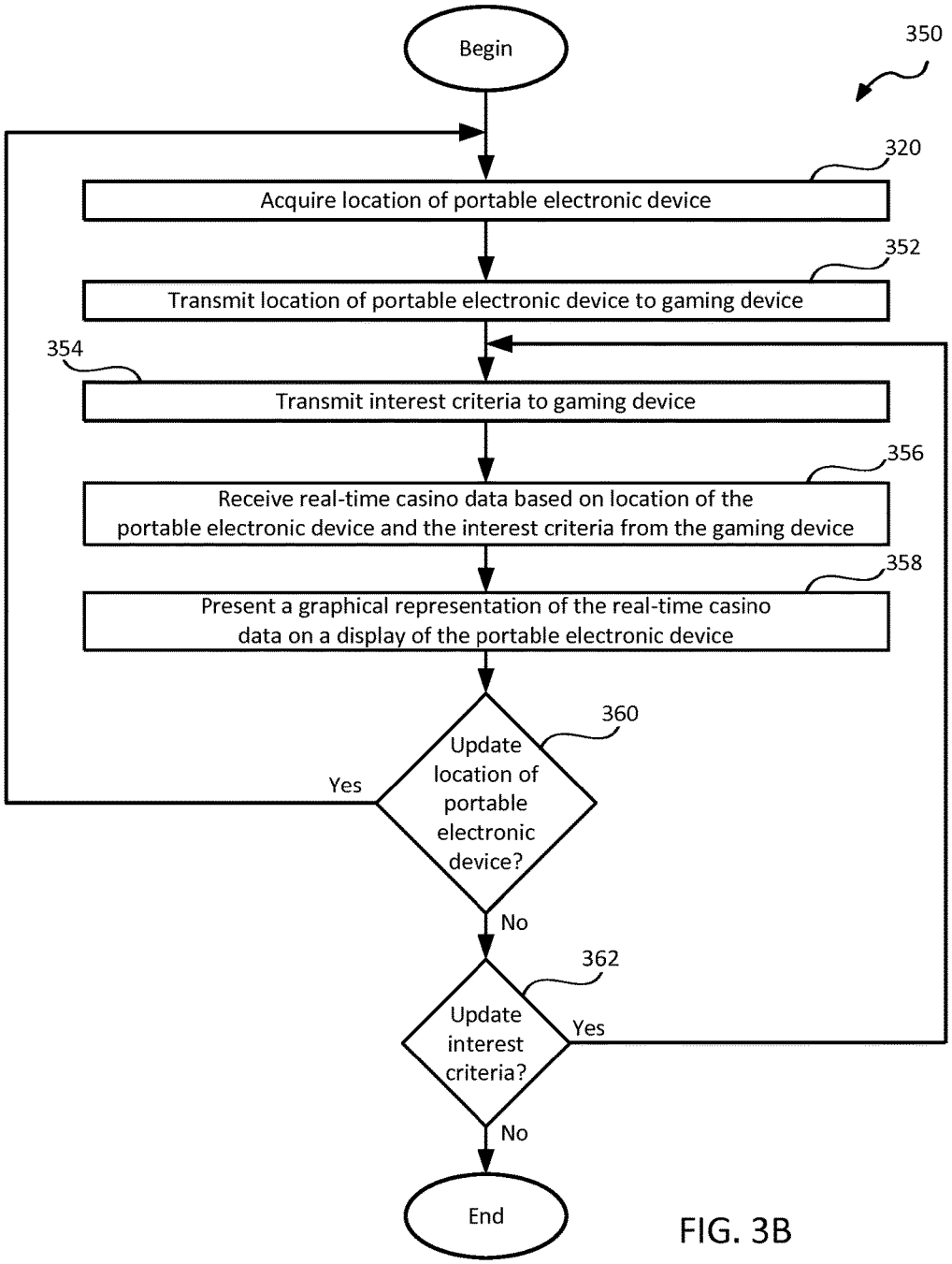
FIG. 3B illustrates a flow diagram of another method for acquiring real-time casino data.

FIG. 3B illustrates a flow diagram of another method 350 for acquiring real-time casino data. The method 350 comprises calculating a location of at least one portable electronic device at 320, transmitting the location of the at least one portable electronic device to a gaming device at 352, transmitting interest criteria to the gaming device at 354, receiving real-time casino data based on the location of the at least one portable electronic device and the interest criteria from the gaming device at 356, and presenting a visual representation of the real-time casino data on a display of the at least one portable electronic device at 358. Prior to the step of displaying, preprocessing maybe carried out to organize and/or prioritize the real-time casino data according to the preference of the user, of the casino, of a third-party sponsor of the application data, of the location of the portable electronic device, or some combination of these. The preference maybe preset or spontaneous.

The location of the at least one portable electronic device at 360 may be periodically updated as described above. After the updated location of the portable electronic device is calculated, the updated location of the at least one portable electronic device may be transmitted to a gaming device at 352 and the remaining steps of the method 350 may repeat thereafter. If there is no updated location of the portable electronic device at 360, then detect whether there is any updated interest criteria at 362. If there is updated interest criteria, the updated interest criteria may be transmitted to the gaming device at 354 and the remaining steps of the method 350 may be repeated thereafter.

From the player's perspective, interest criteria may include gaming machine data such as the time period since the most recent pay-out, gaming machines within a user-preferred predefined zone of the casino floor, gaming machines that share a particular theme, gaming machines that have linked progressives jackpots, a predefined zone of the casino floor having a particular denomination, and the like. From the casino operator's perspective, interest criteria may include players who have spent $50 or more in the last hour, winning players, losing players, gaming machines that generated the least revenue in the past month, top 10 games that received the most plays this week, players who have been at one machine for at least one hour, zones that are most active right now, and the like.

Figure 4A:
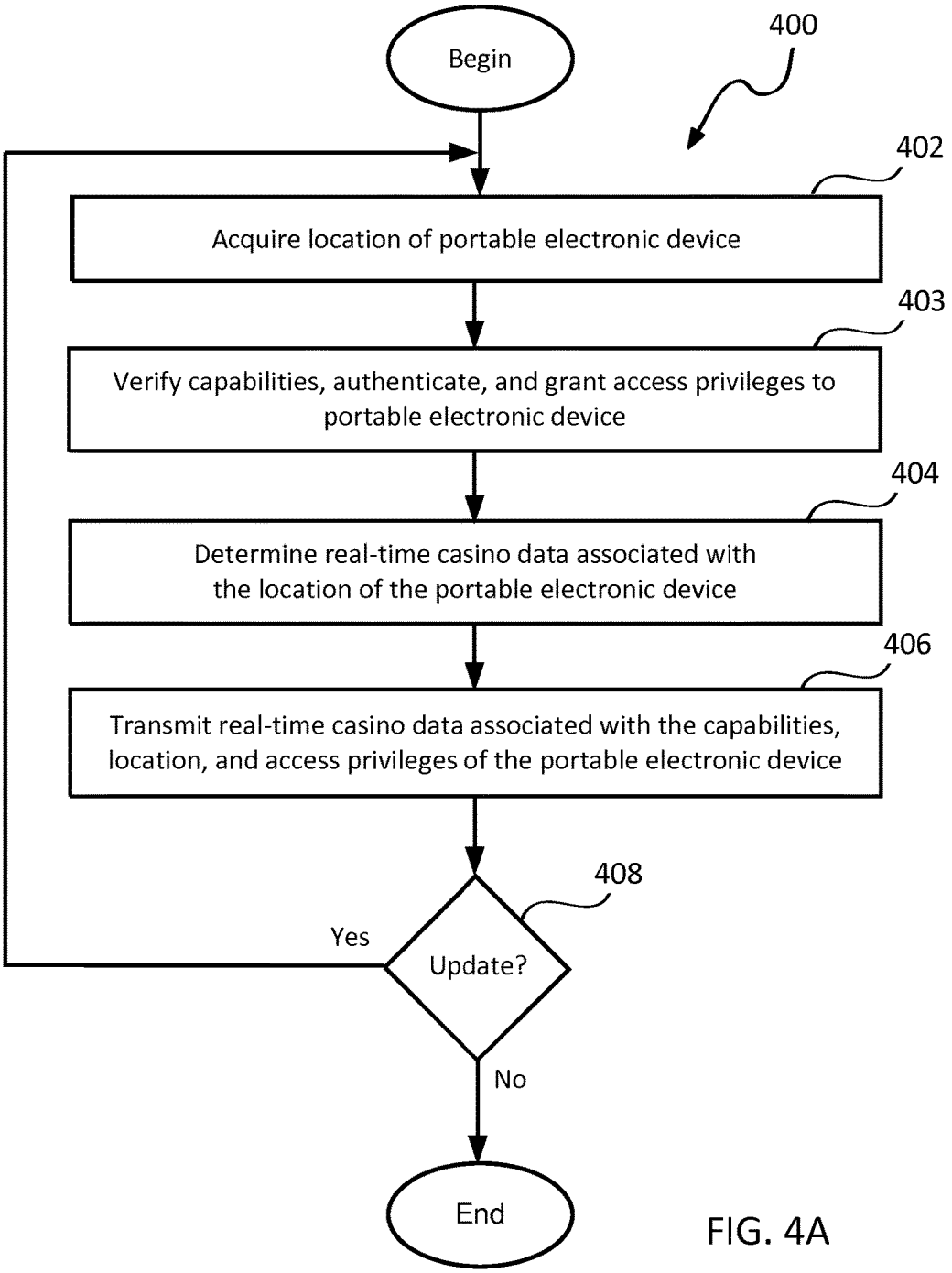
FIG. 4A illustrates a flow diagram of a method for acquiring and updating casino data based on the location of a portable electronic device.

FIG. 4A illustrates a flow diagram of a method for acquiring and updating casino data based on a location of a portable electronic device. The method 400 for acquiring and updating real-time casino data may be performed by acquiring a location of the portable electronic device at 402. In one embodiment, the location of the portable electronic device may be acquired using an indoor location identifying device within the portable electronic device, such as a RF location sensor (hardware, or software based). In another embodiment, the location of the portable electronic device may be calculated using radio frequency (RF) wireless location tracking between the portable electronic device and at least one wireless access point distributed throughout a gaming establishment environment. In yet another embodiment, an RF transceiver within the portable electronic device may be located by its position relative to the closest access point. In still yet another embodiment, triangulation or trilateration methods may be used in conjunction with multiple stationary access points to determine the location of the portable electronic device. For example, RF fingerprinting location appliances, such as the Cisco Wireless Location Appliance™ manufactured by Cisco Systems, Inc. (San Jose, Calif., US), may be used to determine the location of the portable electronic device. RF fingerprinting may further refine a position data associated with the portable electronic device by comparing a live-captured RF characteristic of a current location of the portable electronic device to a known or predicted RF characteristic of a point or zone within the gaming establishment environment. In another example, location data may be determined visually by a plurality of smart cameras distributed throughout the gaming establishment environment. The smart cameras may recognize the portable electronic device by, for example, reading a 2D barcode displayed on the portable electronic device's display, and tracks its location and movement within the gaming establishment environment based on known location data of barcode reader, or nearby fixed objects. Using the portable electronic device to scan for nearby RF beacons and simply decodes their location is yet another method used when exact location is unnecessary.

The location of the portable electronic device may be transmitted to a gaming device within the gaming establishment environment. The gaming device may be a central gaming server, a slot machine, a table game, a portable computer, a smartphone, a tablet computer, an interactive television, and the like. The gaming device that receives the location of the portable electronic device may then authenticate the portable electronic device as a member of the gaming establishment environment network and grant the portable electronic device access privileges sufficient to receive real-time casino data.

After acquiring the location information, a verification of the device capabilities, authentication of the device's software and authentication of the device's access privileges are performed at 403. Real-time casino data and access privileges associated with the location of the portable electronic device may be determined at 404 by the gaming device, transcoded to conform to the portable electronic device's inherent capabilities (display size and resolution, processing and storage capacity, etc.), and transmitted to the portable electronic device from the gaming device at 406. Prior to transmitting, the real-time casino data may further be organized and/or prioritized according to the preference of the user, of the casino, of a third-party sponsor of the application data, of the location of the portable electronic device, or some combination of these. The preference maybe preset or spontaneous. The real-time casino data associated with the location of the portable electronic device may include gaming machine data such as player gaming preferences, player entertainment preferences, gaming machine pay-in data acquired over a predetermined period of time, gaming machine pay-out data acquired over a predetermined period of time, and game session duration data. The gaming machine pay-in and pay-out data acquired over a predetermined period of time may be obtained from a central gaming server or recorded over a predefined period of time from a particular gaming machine of interest to a player.

The real-time casino data may be presented on a display of the portable electronic device. The real-time casino data may be displayed using text, graphical symbols, or augmented reality techniques. The displayed text, graphical symbols, or augmented reality techniques may indicate the location of a gaming machine that has characteristics which an individual player may find desirable. For example, the displayed real-time casino data may indicate the location of gaming machines that have recently paid out a jackpot, gaming machines that have not recently paid out, zones with most payout in the last hour, zones that offer mystery bonuses, and/or the location of particular themed gaming machines the player prefers such as Wheel of Fortune™. The real-time casino data presented on the display of the portable electronic device may also indicate a location of amenities and attractions within the gaming establishment environment, such as restrooms, concierge services, restaurants, shows, and the like.

The real-time casino data may be presented such that at least one gaming machine generating revenue over a predefined period of time may be identified. The gaming machine revenue generation data may also identify at least one gaming machine that has not generated revenue over the predefined period of time.

The augmented reality techniques that present the real-time casino data on the display of the portable electronic device may comprise overlaying a map of the gaming establishment environment, annotations and other indicators, onto real-time video captured and displayed by the portable electronic device. The overlaid map, annotations, and other indicators generated from the real-time casino data may indicate gaming machines that have desired characteristics, suggested rewards to casino managers for high value players, amenities within the gaming establishment environment and/or players that have generated a predefined amount of revenue for the casino, and the like. The overlaid map may be referred to as an augmented reality map, and the augmented reality map may be periodically updated when the portable electronic device acquires new real-time casino data and/or when the location, or other triggering events, of the portable electronic device changes as described below.

The real-time casino data associated with the portable electronic device may be periodically updated at 408. Several events may trigger updates of the real-time casino data associated with the portable electronic device. For example, the real-time casino data associated with the portable electronic device may update after a predefined period of time has elapsed, or upon a manual request by the user, or upon a change in the location of the portable electronic device, or when a new data set is available such as new bonus offers by the bonusing controller at the current location. After the location of the portable electronic device changes, the method for acquiring the location of the portable electronic device may be repeated.

Figure 4B:
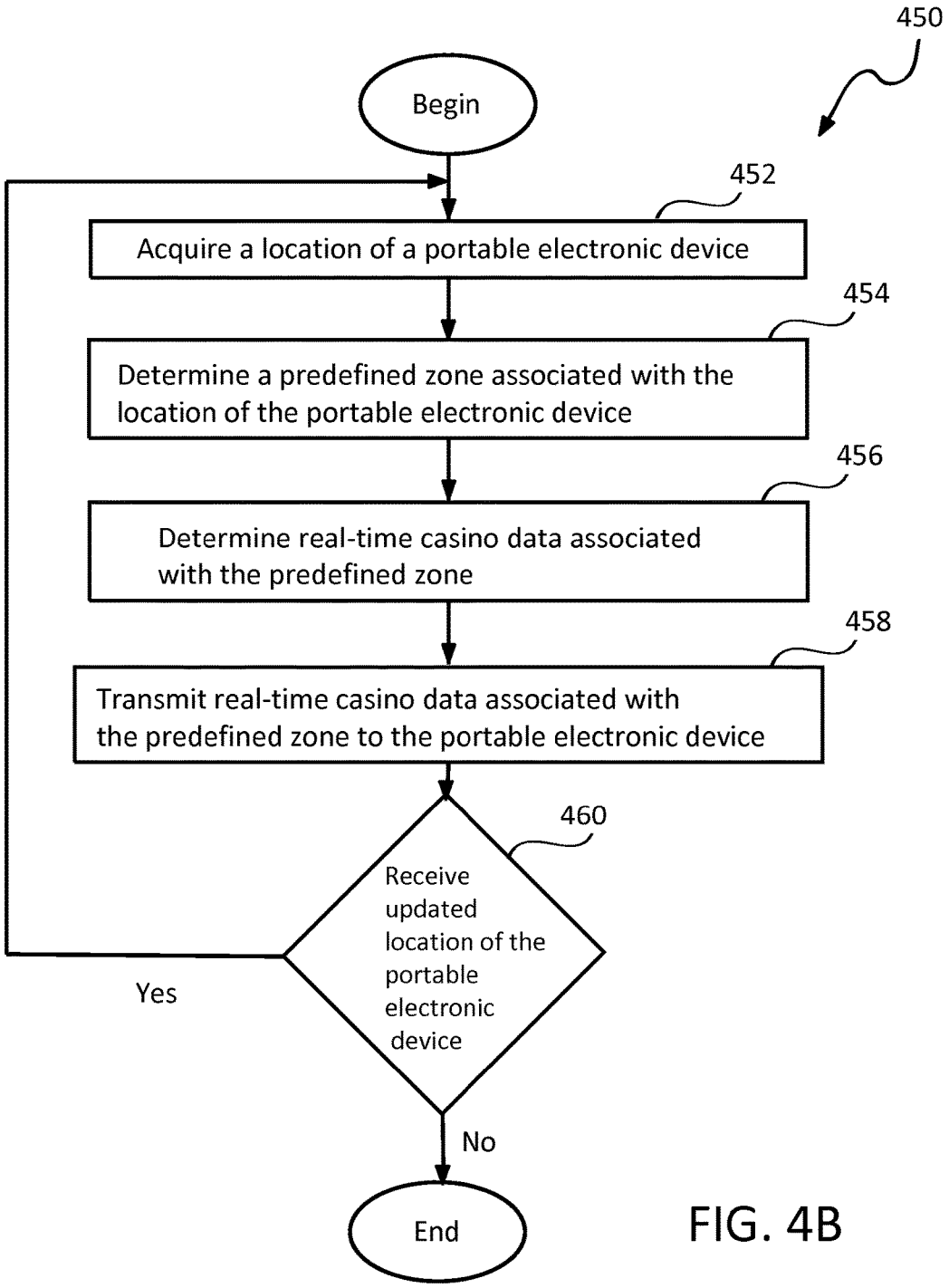
FIG. 4B illustrates a flow diagram of a method for acquiring and updating real-time casino data based on the location of a portable electronic device associated with a predefined zone within the gaming establishment environment.

FIG. 4B illustrates a flow diagram of a method for acquiring and updating real-time casino data based on a location of a portable electronic device associated with a predefined zone within a gaming establishment environment. One advantage with a predefined zone is that it is simple to implement in a piecemeal manner and scaled up as needed. All gaming devices within the zone are grouped together—versus individually tracking each device's location, privilege, preferences, permission, etc. Devices in the same zone have access to the same data, and eligible to receive the same benefits. Precise location tracking of each device within a zone is no longer required, lowering the cost of equipment, software complexity, and implementation. Further, a zone may have its own dedicated server catering to devices within the zone only. Operationally, information can be broadcast instead of one-to-one communication. For example, a mystery bonus event can be broadcasted to all devices present on the second floor of the casino. The method 450 for acquiring and updating real-time casino data associated with a predefined zone within the gaming establishment environment may be performed by acquiring a location of the portable electronic device at 452. In one embodiment, the location of the portable electronic device may be acquired using an indoor or outdoor location identifying device within the portable electronic device. In another embodiment, the location of the portable electronic device may be calculated using radio frequency (RF) wireless location tracking between the portable electronic device and at least one wireless access point distributed throughout the gaming establishment environment. In yet another embodiment, an RF transceiver within the portable electronic device may be located by its position relative to the closest access point. In still yet another embodiment, triangulation or trilateration methods may be used in conjunction with multiple stationary access points to determine the location of the portable electronic device. For example, RF fingerprinting location appliances, such as the Cisco Wireless Location Appliance™ manufactured by Cisco Systems, Inc. (San Jose, Calif., US), may be used to determine the location of the portable electronic device. RF fingerprinting may further refine the position data associated with the portable electronic device by comparing the live-captured RF characteristic of the current location of the portable electronic device to a known or predicted RF characteristic of a point or zone within the gaming establishment environment. In another example, location data may be determined visually by a plurality of smart cameras distributed throughout the gaming establishment environment. The smart cameras may recognize the portable electronic device by, for example, reading a 2D barcode displayed on the portable electronic device's display, and tracks its location and movement within the gaming establishment environment based on known location data of barcode reader, or nearby fixed objects. Using the portable electronic device to scan for nearby RF beacons and simply decodes their location is yet another method used when exact location is unnecessary.

The location of the portable electronic device may be associated at 454 with a predefined zone within the gaming establishment environment casino floor. The casino floor may be divided into at least one predefined zone. Certain features of the casino floor may be grouped together within the predefined zones. For example, one zone may contain at least one slot machine and another zone may contain at least one table game. In another example, a predefined zone may contain casino amenities such as at least one restaurant, concierge kiosk, theatre, and the like. As previously discussed, a zone can be physical, virtual (logically grouped), or some combinations of both. Further, each zone can have a dedicated server catering to the gaming devices within the zone, making it easy to implement a location-based function one area at a time on the casino floor.

A gaming machine may determine at 456 real-time casino data associated with the predefined zone on the casino floor that may contain the portable electronic device. The gaming machine may then transmit at 458 the real-time casino data associated with the predefined zone on the casino floor to the portable electronic device. Prior to transmitting, the real-time casino data may further be organized and/or prioritized according to the preference of the user, of the casino, of a third-party sponsor of the application data, of the location of the portable electronic device, or some combination of these. The preference maybe preset or spontaneous. The real-time casino data associated with the predefined zone on the casino floor may include gaming machine data such as player gaming preferences, player entertainment preferences, gaming machine pay-in data acquired over a predetermined period of time, gaming machine pay-out data acquired over a predetermined period of time, and game session duration data. The gaming machine data may be organized by each machine's location on the casino floor, or logically grouped. The gaming machine pay-in and pay-out data acquired over a predetermined period of time may be obtained from a central gaming server or recorded over a predefined period of time from a particular gaming machine or predefined zone on the casino floor of interest to a player. Real-time casino data acquisition maybe periodically updated when a triggering event occurs, such as when the user moved to a different zone, at a predetermined time interval, when the user manually requests a data refresh, and the like. Using the acquired data, a casino manager may evaluate a player's value to the casino, and may award spontaneous perks such as cash back, bonus spins, food/drink vouchers, etc.

The real-time casino data associated with the predefined zone on the casino floor may be presented on a display of the portable electronic device. The real-time casino data associated with the predefined zone on the casino floor may be displayed using text, graphical symbols, or augmented reality techniques such as an augmented reality map where annotations and other indicators are superimposed on a live video stream. The displayed text, graphical symbols, or augmented reality techniques may indicate the location of gaming machines within a predefined zone on the casino floor that have characteristics, which an individual player may find desirable. For example, the displayed real-time casino data may indicate the location of gaming machines within the predefined zone that have recently paid out a jackpot, gaming machines that have not recently paid out, hot players, bonus zones, and/or the location of particular themed gaming machines within the predefined zone the player prefers. The real-time casino data associated with the predefined zone on the casino floor presented on the display of the portable electronic device may also indicate the location of amenities and attractions within the gaming establishment environment, such as restrooms, concierge services, restaurants, shows, and the like.

The real-time casino data may be presented such that at least one gaming machine associated with the predefined zone on the casino floor generating revenue over the predefined period of time may be identified. The gaming machine revenue data may also identify at least one gaming machine within the predefined zone that has not generated revenue over the predefined period of time.

The augmented reality techniques used to present the real-time casino data on the display of the portable electronic device may comprise overlaying a map of the predefined zone, computer generated annotations and other indicators, within the gaming establishment environment onto real-time video captured and displayed by the portable electronic device. The overlaid map and notes may indicate gaming machines within the predefined zone that have desired characteristics, amenities within the gaming establishment environment and/or players within the predefined zone that have generated a predefined amount of revenue for the casino. The overlaid map may be referred to as an augmented reality map, and the augmented reality map may be periodically updated when the portable electronic device acquires new real-time casino data and/or when the location of the portable electronic device changes as described above.

The real-time casino data associated with the predefined zone on the casino floor containing the portable electronic device may be periodically updated and/or reprioritized at 460. For example, the real-time casino data associated with the portable electronic device may update after the predefined period of time has elapsed, upon a change in the location of the portable electronic device, or when a new offer/event has been initiated. The update may initiate when the portable electronic device moves from one predefined zone on the casino floor to another predefined zone on the casino floor. After the location of the portable electronic device changes, the method for acquiring the location of the portable electronic device may be repeated.

Figure 5A:
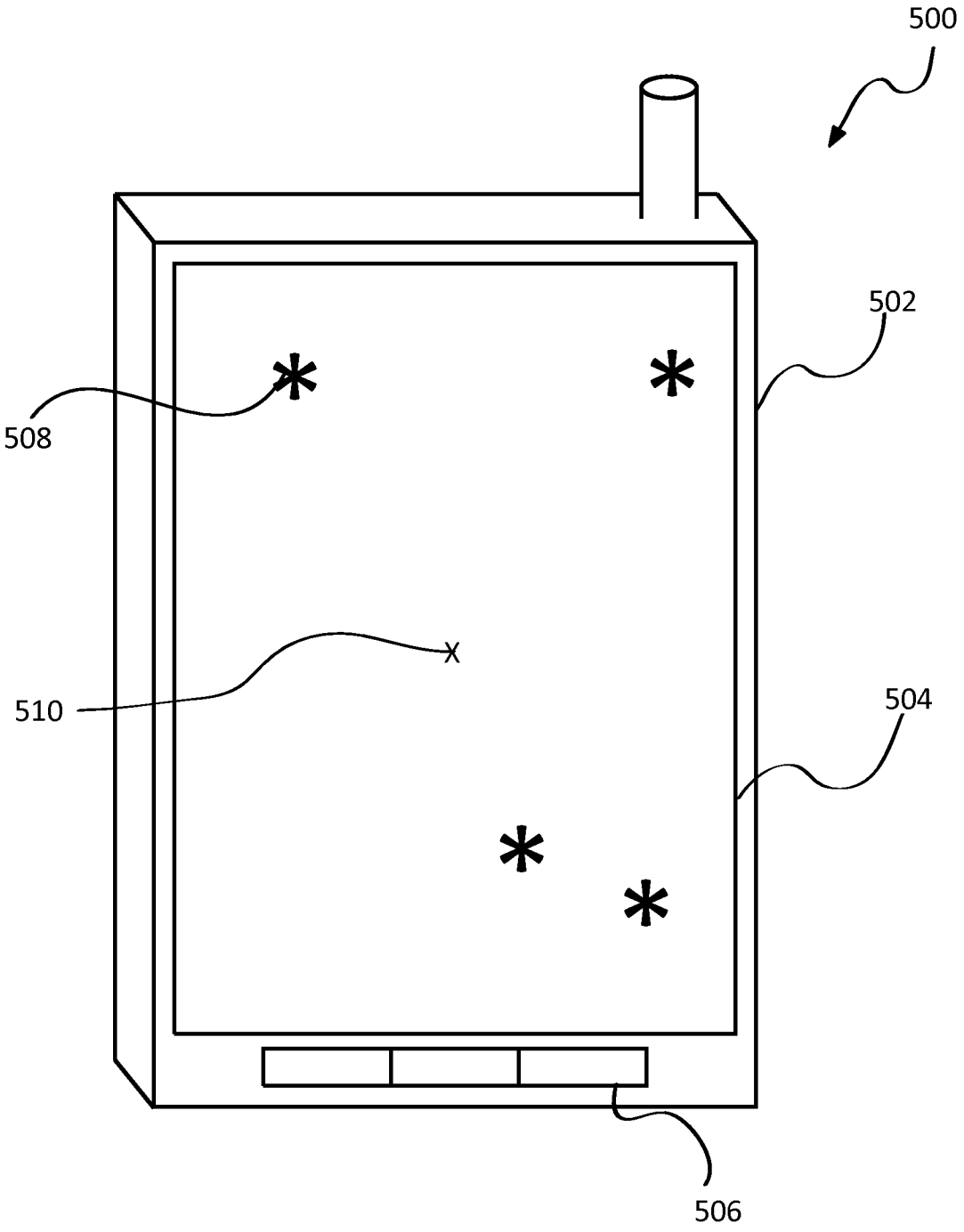
FIG. 5A illustrates a front view of an example portable electronic device presenting real-time casino data.

FIG. 5A illustrates a front view of a portable electronic device presenting real-time casino data. The portable electronic device 500 may have a housing 502 that may support a display 504. The display 504 could be, but is not limited to, a touch screen configured to receive input from a user. The portable electronic device 500 may also have user actuatable buttons 506 that may allow the user to navigate the real-time casino data presented on the display 504. The real-time casino data may be visually represented as a map of a casino floor within a gaming establishment environment. The map may display an icon 510 denoting a current location of the portable electronic device. The map may also display another icon 508 denoting gaming machines or other features of the casino floor of interest to the user. For example, the icons 508 may mark the locations of gaming machine that have not paid out within a user-defined period of time. As another example, the icons 508 may denote locations of a desired amenity, such as restrooms, on the casino floor relative to the user's current location marked by the icon 510.

Figure 5B:
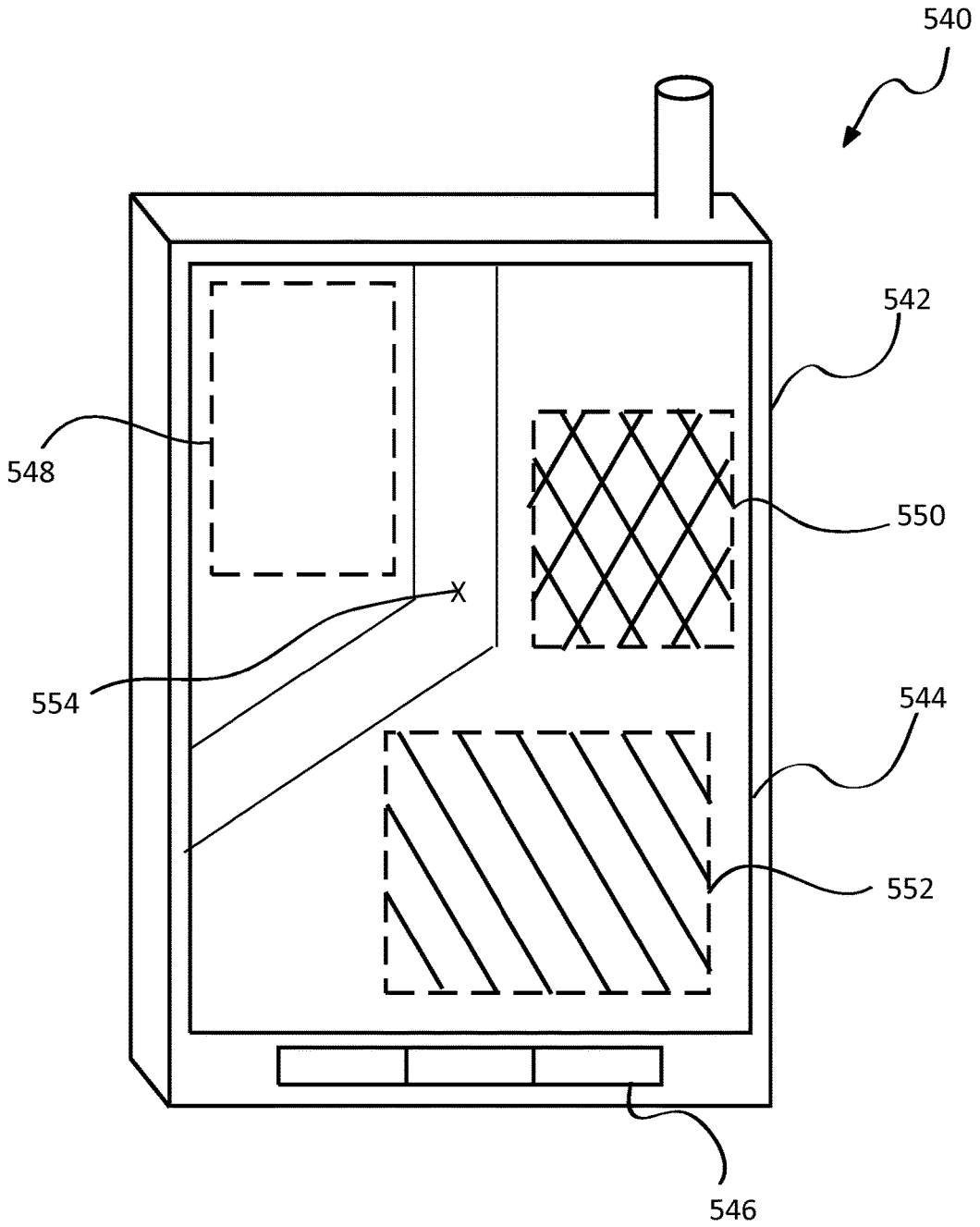
FIG. 5B illustrates a front view of an example portable electronic device presenting real-time casino data associated with at least one predefined zone on the casino floor.

FIG. 5B illustrates a front view of a portable electronic device presenting real-time casino data associated with at least one predefined zone on a casino floor. The portable electronic device 540 may have a housing 542 that may support a display 544. The display 544 could be, but is not limited to being, a touch screen configured to receive input from a user. The portable electronic device 540 may also have user actuatable buttons 546 that may allow the user to navigate the real-time casino data associated with at least one predefined zone on the casino floor presented on the display 544.

The real-time casino data associated with the at least one predefined zone on the casino floor may be visually represented as a map of the casino floor within the gaming establishment environment. The map may display an icon 554 denoting the current location of the portable electronic device that may be carried by the user. The map may also display icons representing at least one predefined zone on the casino floor. For example, the map may display a predefined zone 548 that contains mainly table games. In another example, the map may display a predefined zone 550 that contains mainly slot machines with mystery bonus feature. In yet another example, the map may display a predefined zone 552 that contains mainly casino amenities such as a bar or restaurant. In still yet another example, the relative locations of the predefined zones 548, 550, and 552 may be displayed relative to the icon 554 denoting the current location of the portable electronic device. The relative locations of the predefined zones 548, 550, and 552 may be denoted by unique graphical representations on the map such as color highlights, annotations, contours, and other textual or graphical indicators. For example, zone 548 may be denoted by an open rectangle drawn with dotted lines while zone 550 may be denoted by a cross-hatched rectangle drawn with dotted lines. Zone 552 may be similarly denoted by a hatched rectangle drawn with dotted lines. The respective shadings of the rectangles representing zones 548, 550, and 552 may allow the user to quickly and easily identify zones of interest on the casino floor.

Figure 5C:
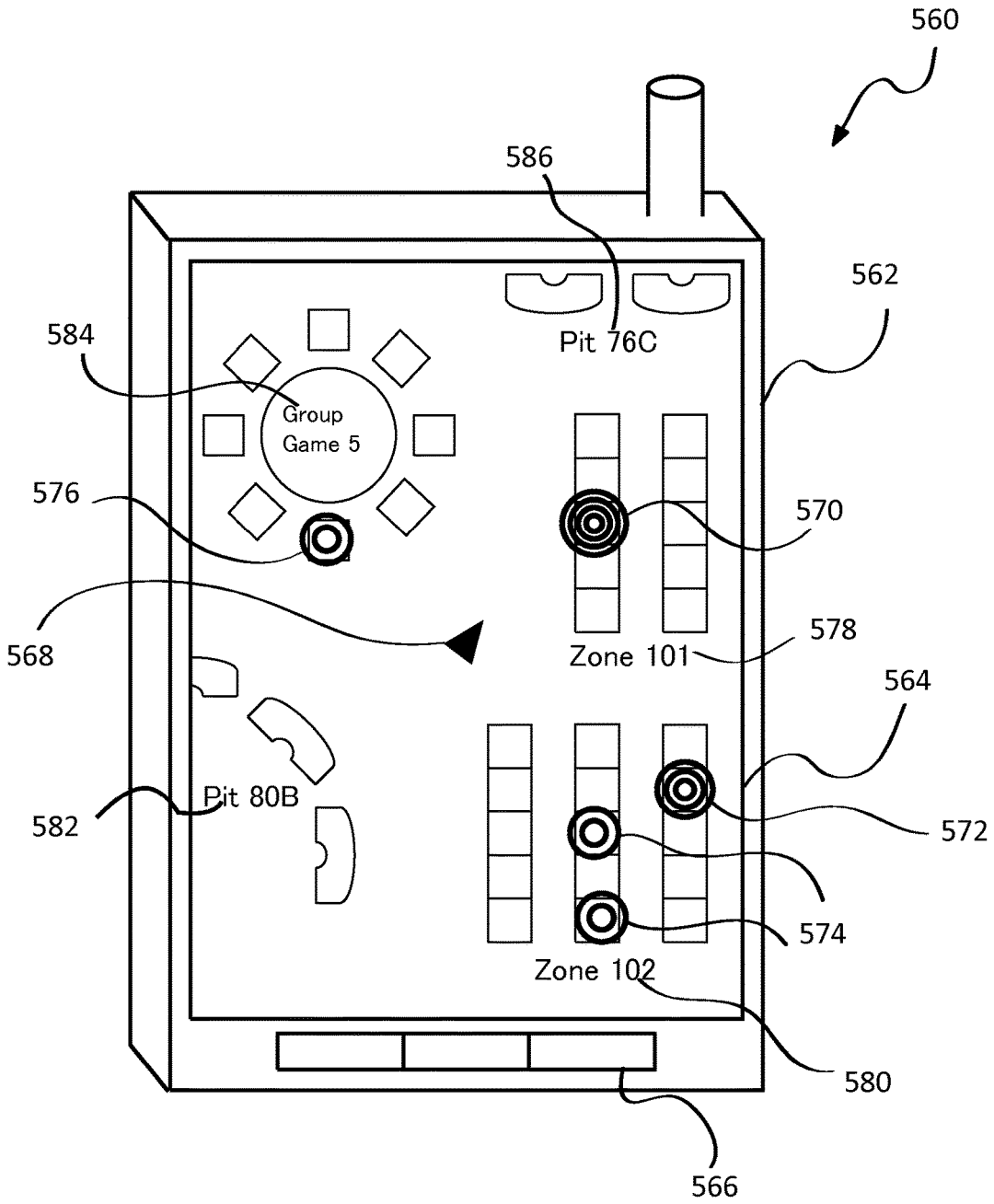
FIG. 5C illustrates a front view of an example portable electronic device presenting real-time casino data associated with at least one predefined zone on the casino floor as a gaming heat map.

FIG. 5C illustrates a front view of an example portable electronic device presenting real-time casino data associated with at least one predefined zone on a casino floor as a gaming heat map. The portable electronic device 560 may have may have a housing 562 that may support a display 564. The display 564 could be, but is not limited to, a touch screen configured to receive input from a user. The portable electronic device 560 may also have user actuatable buttons 566 that may allow the user to navigate the real-time casino data associated with at least one predefined zone on the casino floor presented on the display 564.

The real-time casino data associated with the at least one predefined zone on the casino floor may be visually represented as the gaming color heat map of the casino floor within the gaming establishment environment. The gaming color heat map may be defined as a visual representation of real-time casino data that can be translated to activities associated with predefined zones on the casino floor wherein desired features of the gaming establishment environment are prioritized and depicted visually according to their priority. For example, a player may desire to locate gaming machines within proximal predefined zones on the casino floor that have not paid out within a predefined period of time. The real-time casino data displayed on the portable electronic device may display the gaming color heat map of the casino floor with an icon representing the player 568 centered on the gaming heat map. The gaming color heat map may also display the at least one predefined zone 578 and 580 on the casino floor that contain gaming machines that have not paid out within the predefined period of time. The real-time casino data representing at least one gaming machine that has not paid out within the predefined period of time may be ranked by longest time since the last pay-out and displayed as color gradients or contours according to the ranking where the longest amount of time has elapsed since gaming machine 570 paid out, less time has elapsed since gaming machine 572 has paid out, and still less time has elapsed since gaming machines 574 paid out.

The gaming color heat map may depict at least one zone 578 and 580, and may also depict different game genres and other features such as bonus and progressives on one map. In another example, slot machines in zones 578 and 580 may be directly compared with a group game 584. In this example, an approximately equivalent amount of time has elapsed since slot machines 574 and group game 576 has paid out. The gaming heat map may also depict other predefined zones on the casino floor such as zones 582 and 586 devoted to table gaming machines.

Figure 6A:
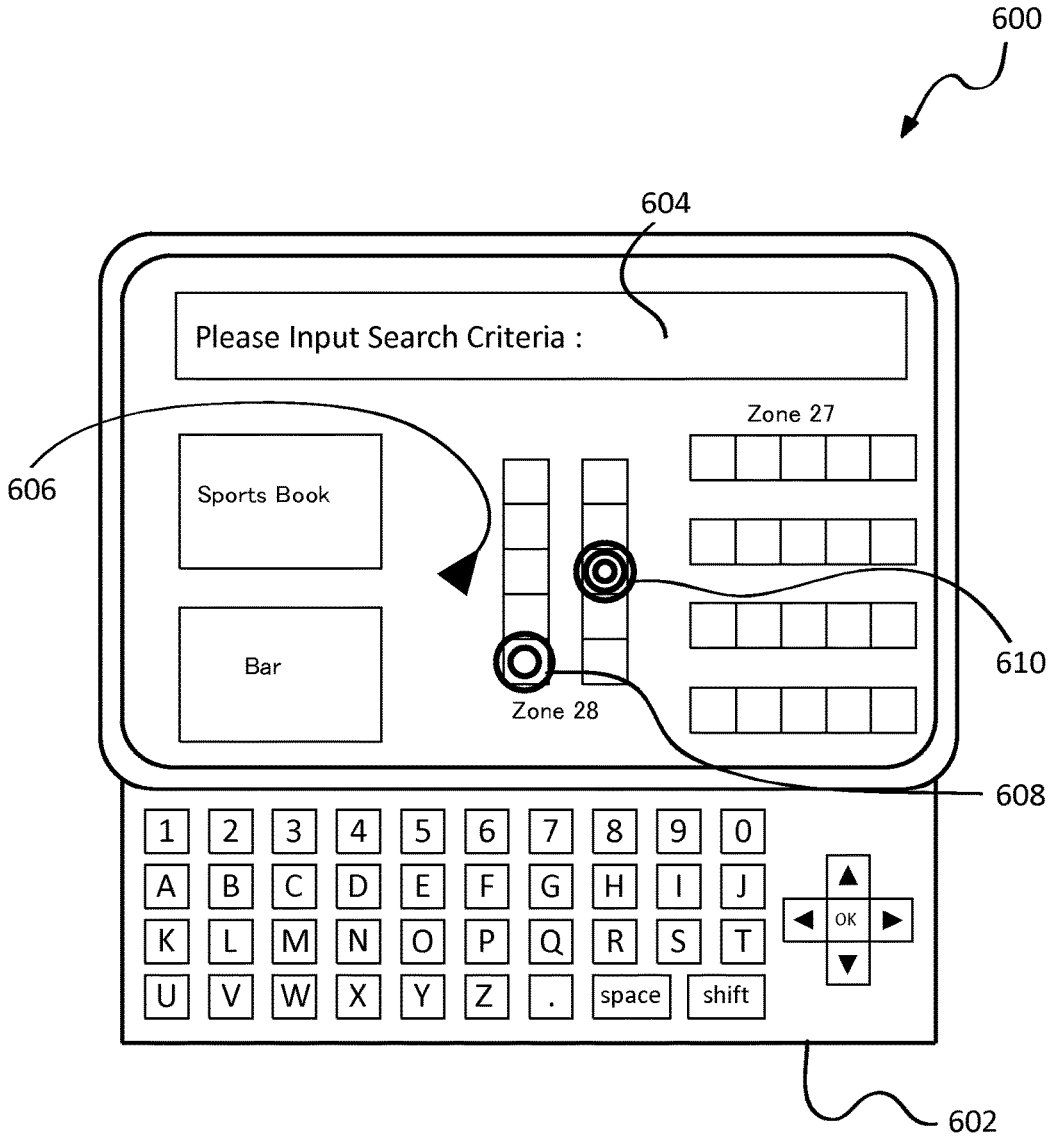
FIG. 6A illustrates an example of a portable electronic device presenting a gaming heat map.

FIG. 6A illustrates an example of a portable electronic device presenting a gaming heat map. The gaming heat map 614 is one embodiment of a visual representation of real-time casino data. Although FIG. 6A is described with reference to slot machines or game features, this is not intended to be limiting as the gaming color heat map could be for video poker machines, gaming tables, roulette tables, keno games or other such games of chance. While the portable electronic device 602 is illustrated as a mobile phone, this is not intended to be limiting as the portable electronic device 602 can be a personal media player, portable gaming device, netbook, tablet device, personal digital assistant or any other similar device.

The portable electronic device 602 may have a display 612 that can present the gaming heat map 614. The display 612 can be a liquid crystal display screen, organic light-emitting diode screen or any other type of display device found in portable electronic devices. The display 612 can have touch screen capabilities that may allow a user to manipulate the gaming heat map 614. The portable electronic device 602 may also have physical buttons or keys that can also allow the user to manipulate the gaming heat map 614.

The gaming color heat map 614 can include a casino map 616. The casino map 616 may be a scaled line drawing, photograph, live video or any other type of map. The casino map 616 may have labels and other annotations for gaming machines, game features, gaming tables, restaurants, bars, amenities, and other structures that appear within the casino map 616. In one embodiment, the casino map 616 may display a portion of the casino floor within a predefined radius around a location of the portable electronic device 602. The predefined radius may be user or casino defined. In another embodiment, the casino map 616 may display a predefined zone that the location of the portable electronic device 602 is within. The casino map 616 may refresh and display a different portion of the casino floor based upon an updated location of the portable electronic device 602 or when a new offer/event has been initiated.

The gaming heat map 614 can have an indicator 606 for the location of the portable electronic device. The indicator 606 for the location of the portable electronic device may be an icon, shape, symbol, picture, numeral, character, text or the like. The indicator 606 for the location of the portable electronic device may include location data such as coordinates and orientation. In one embodiment, the location data may be represented by the indicator 606 for the location of the portable electronic device. For example, the indicator 606 for the location of the portable electronic device can be an arrowhead, where a position of the arrowhead represents coordinates and a direction the arrowhead points represents orientation. In another embodiment, the location data can be represented by additional text adjoining the indicator 606.

The gaming color heat map 614 may have a search mechanism 604 that accepts input of at least one criterion. The search mechanism 604 can be a text input box, drop down menu, or any other mechanism that accepts user input. The user can input the at least one criterion into the search mechanism 604 via the display 612 with touch screen capabilities, the physical buttons or keys, or any other input device on the portable electronic device 602. The at least one criterion can be slot machine type, wager amount, game type, game theme, mystery bonus zone, game promotional zone, upcoming promotional zone, gaming machine data, player entertainment preferences or any other user criteria. The gaming machine data may include game session duration data, periodic pay-in data, and periodic pay-out data. The periodic pay-out data may include length of time since the last pay-out, frequency of pay-outs, amount of pay-outs, and the like.

The gaming heat map 614 may identify at least one slot machine based on the at least one criterion. The identified at least one slot machine can be represented on the gaming heat map 614 by an icon, shape, symbol, picture, numeral, character, text or other such indicia. In one embodiment, the identified at least one slot machine may be represented by a concentric ring symbol or contour lines. A slot machine represented by a concentric ring symbol with three rings 610 or tight contour lines may be a closer match to the at least one criterion then a slot machine represented by a concentric ring symbol with two rings 608 or sparse contour lines. Although the degree of correlation between a particular identified slot machine and the at least one criterion is illustrated here by the number of concentric rings, this is not intended to be limiting. The degree of correlation may be represented not only by the number of indicia but also indicia size, indicia type, color, letter grade, percentage, and the like.

Figure 6B:
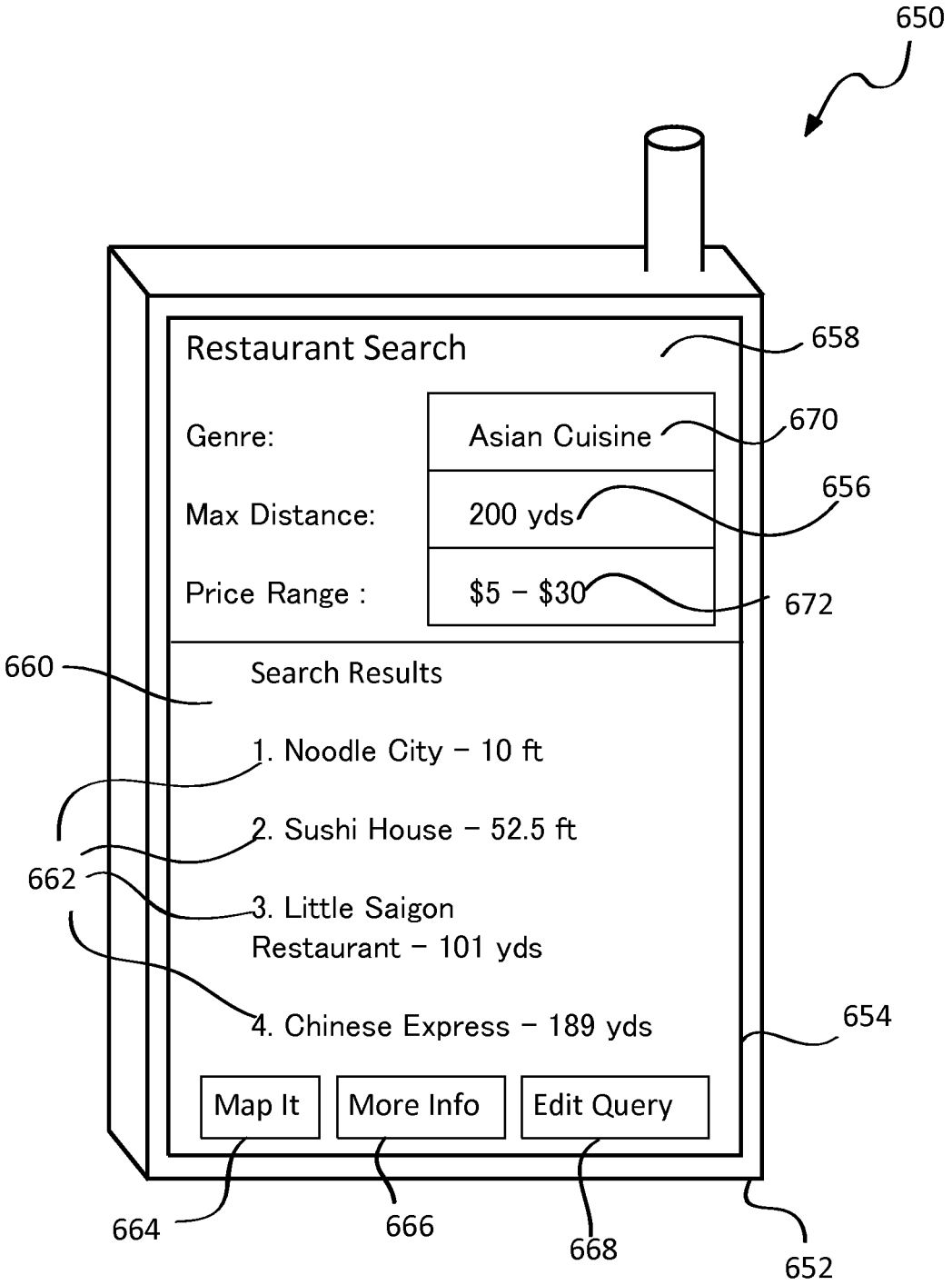
FIG. 6B illustrates an example of a portable electronic device presenting an entertainment query.

FIG. 6B illustrates an example of a portable electronic device presenting an entertainment query. Although FIG. 6B is described with reference to restaurants, this is not intended to be limiting as the entertainment query could be for bars, lounges, night clubs, theaters, shows, shopping, rides, or other such casino entertainment. While the portable electronic device 652 is illustrated as a mobile phone, this is not intended to be limiting as the portable electronic device 652 can be a personal media player, portable gaming device, netbook, tablet device, personal digital assistant or any other similar device.

The portable electronic device 652 may have a display 654 that can present the entertainment query 674. The display 654 can be a liquid crystal display screen, organic light-emitting diode screen or any other type of display device found in portable electronic devices. The display 654 can have touch screen capabilities that may allow a user to manipulate the entertainment query 674. The portable electronic device 652 may also have physical buttons or keys that can also allow the user to manipulate the entertainment query 674.

The entertainment query 674 may have a search mechanism 658 that accepts input of at least one criterion. The search mechanism 658 can have a single or multiple text input boxes, drop down menus, or the like. In one example, where the entertainment query 674 is for restaurants, the search mechanism 658 may contain a genre text input box 670, a max distance text input box 656, and a price range text input box 672. The genre text input box 670 can accept user food genre preferences such as pizza, Italian, vegetarian burrito, Asian cuisine, and any other food preferences the user may have. The max distance text input box 656 may accept a maximum distance for a restaurant location from a current location of the portable electronic device 652. The price range text input box 672 can accept user price range preferences. The at least one criterion may also include restaurant ratings. The user can input the at least one criterion into the search mechanism 658 via the display 654 with touch screen capabilities, the physical buttons or keys, or any other input device on the portable electronic device 652.

The entertainment query 674 may have a search results dialogue 660. The search results dialogue 660 may contain a plurality of search result items 662. Each search result item may include a name for a particular search result item and a distance from the particular search result item to the current location of the portable electronic device 652. The plurality of search result items 662 may be arranged in a list based upon degree of correlation to the at least one criterion, distance, price, alphabetical order, or any other sorting or ordering method.

The entertainment query 674 may have a map it function 664. The map it function 664 may present a casino map on the display 654. The casino map may be a scaled line drawing, photograph, or any other type of map. The casino map may have labels for gaming machines, gaming tables, restaurants, bars, amenities, and other structures that appear within the casino map. The casino map may indicate the current location of the portable electronic device 652 and the location of a selected search result item. The map it function 664 may also present navigation directions from the current location of the portable electronic device 652 to a location of the selected search result item on the display 654.

The entertainment query 674 may have a more info function 666. The more info function 666 may present additional information associated with the selected search result item on the display 654. The additional information may include menus, price range, recommended dishes, specials, sales, pictures, show programs, theater maps, casino promotions, and the like. The entertainment query 674 may have an edit query function 668. The edit query function 668 may facilitate editing of the at least one criterion. Editing may be performed via the display 654 with touch screen capabilities, the physical buttons or keys, or any other input device on the portable electronic device 652.

Figure 7A:
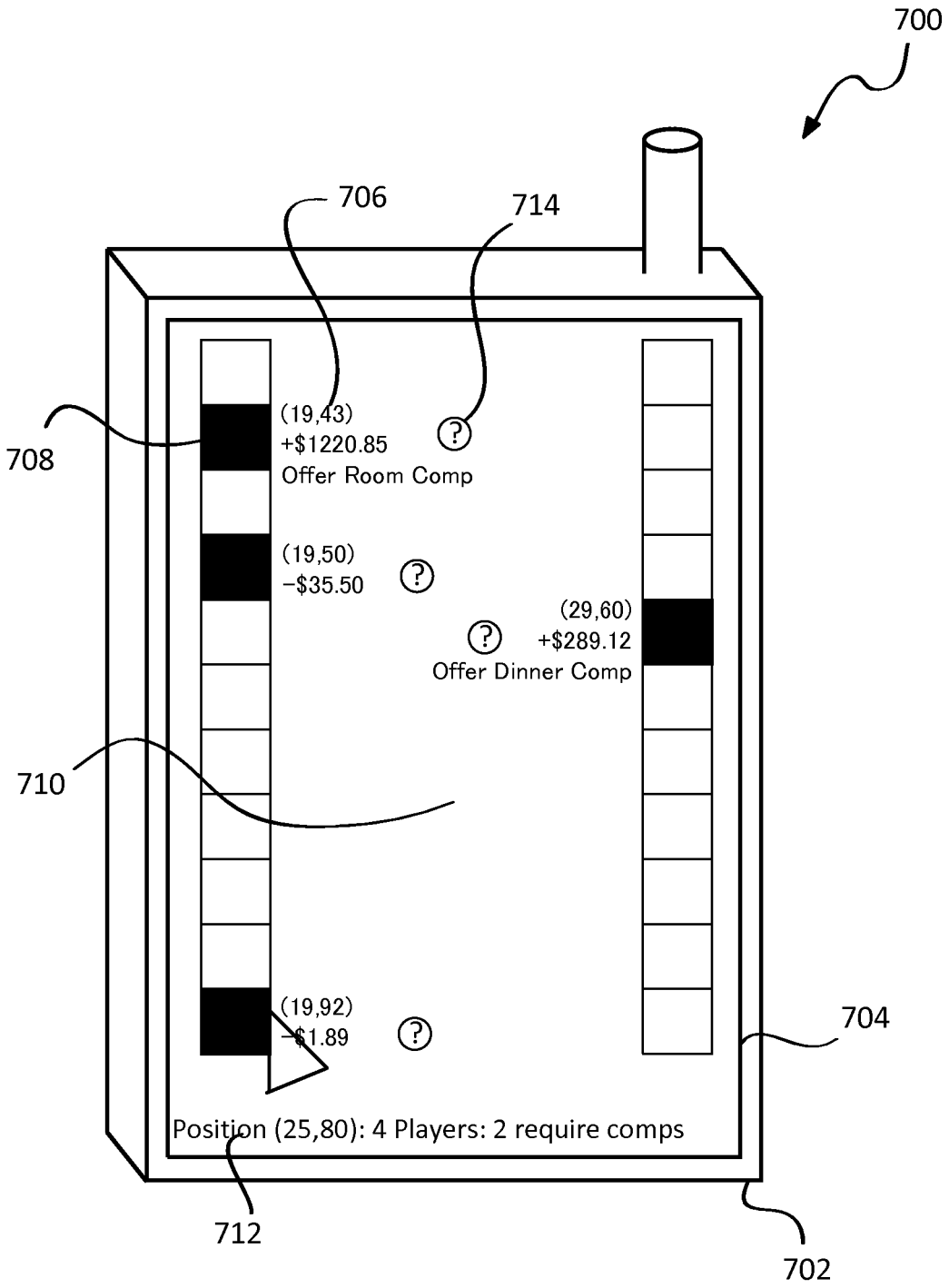
FIG. 7A illustrates an example of a portable electronic device presenting a compensation visual representation.

FIG. 7A illustrates an example of a portable electronic device presenting a player compensation visual representation. Although FIG. 7A is described with reference to slot machine players, this is not intended to be limiting as the compensation visual representation 716 could be for players of video poker machines, gaming tables, roulette tables, keno games or other such games of chance. While the portable electronic device 702 is illustrated as a mobile phone, this is not intended to be limiting as the portable electronic device 702 can be a personal media player, portable gaming device, netbook, tablet device, personal digital assistant or any other similar device.

The portable electronic device 702 may have a display 704 that can present the player compensation visual representation 716. The display 704 can be a liquid crystal display screen, organic light-emitting diode screen or any other type of display device found in portable electronic devices. The display 704 can have touch screen capabilities that may allow a user to manipulate the compensation visual representation 716. The portable electronic device 702 may also have physical buttons or keys that can also allow the user to manipulate the compensation visual representation 716.

The player compensation visual representation 716 can have an indicator 710 denoting a location of the portable electronic device. The indicator 710 denoting the location of the portable electronic device may be an icon, shape, symbol, picture, numeral, character, text or the like. The indicator 710 denoting the location of the portable electronic device may include location data such as coordinates and orientation.

In one embodiment, the location data may be represented by the indicator 710 denoting the location of the portable electronic device. For example, the indicator 710 denoting the location of the portable electronic device can be an arrowhead, where a position of the arrowhead represents coordinates and a direction the arrowhead points represents orientation. In another embodiment, the location data can be represented by additional text adjoining the indicator 710.

The player compensation visual representation 716 can include a casino map 718. The casino map 718 may be a scaled line drawing, photograph, still image, live video, or any other type of map. The casino map 616 may have labels for gaming machines, gaming tables, restaurants, bars, amenities, and other structures that appear within the casino map 718. In one embodiment, the casino map 718 may display a portion of the casino floor within a predefined radius around a location of the portable electronic device 702. The predefined radius may be user or casino defined. In another embodiment, the casino map 718 may display a predefined zone that the location of the portable electronic device 702 is within. The casino map 718 may refresh and display a different portion of the casino floor based upon an updated location of the portable electronic device 702 or when a new offer/event has been initiated.

The player compensation visual representation 716 may have an indicator 708 for slot machines currently being played. Although the indicator 708 may be illustrated by a blacked out square, this illustration is not intended to be limiting as the indicator can be an icon, shape, symbol, picture, numeral, character, text or the like. The indicator 708 for slot machines currently being played may also comprise additional text 706. The additional text 706 may include slot machine coordinates, slot machine revenue, suggested comps for a player based upon slot machine revenue, and other information relevant to player comps. The indicator 708 may also comprise a more info button 714. The more info button 714 may present information such as preferred slot machine type, preferred game features, wager amount, game type, game theme, player entertainment preferences, game session duration data, pay-in data, length of time since the last pay-out, frequency of pay-outs, amount of pay-outs, and the like on the display 704.

The compensation visual representation 716 may have a status notification dialogue 712. The status notification dialogue 712 can display coordinates for the location of the portable electronic device, the number of slot machines currently being played, how many comps should be granted, and other information important to a casino host.

Figure 7B:
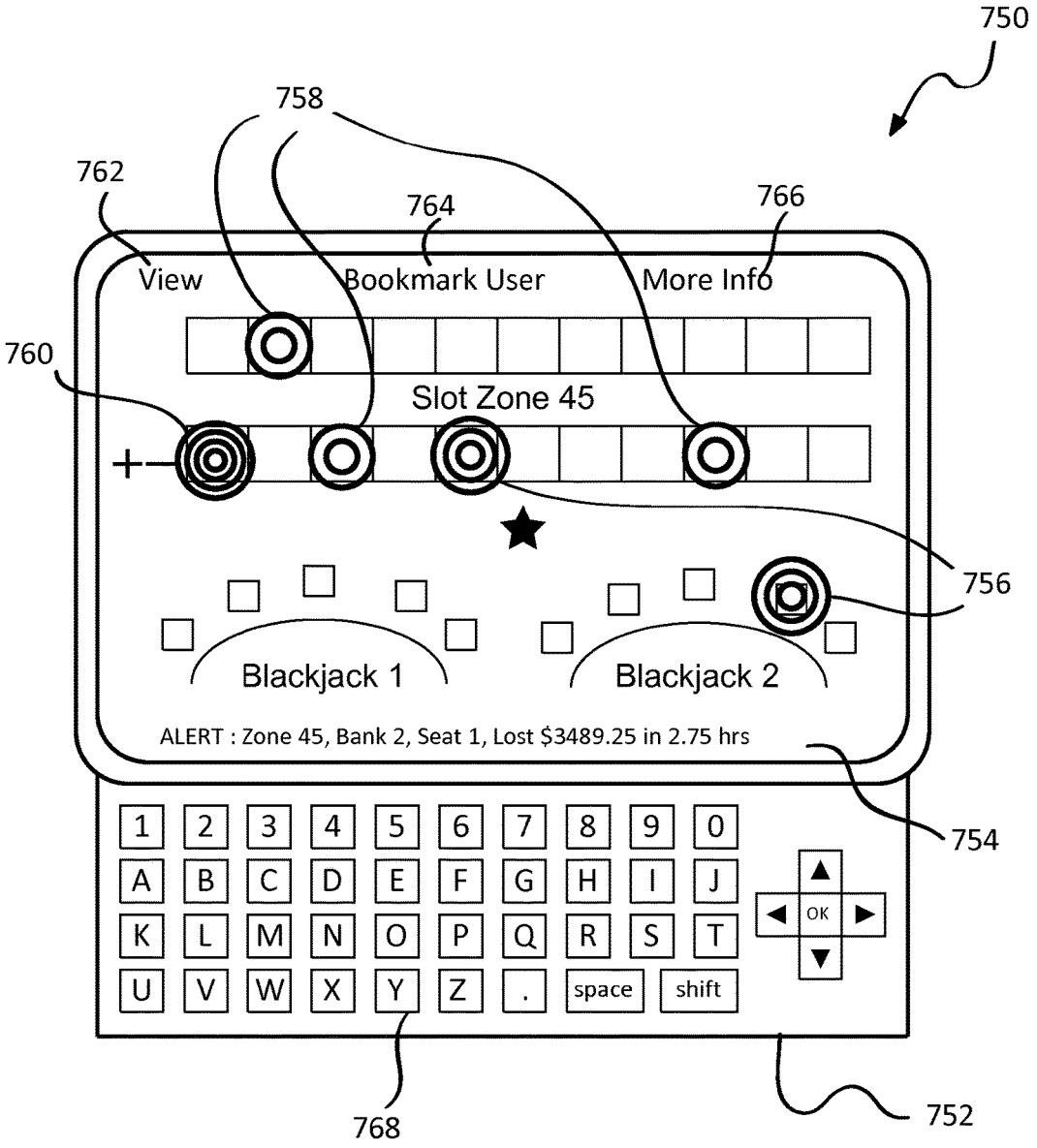
FIG. 7B illustrates an example of a portable electronic device presenting a revenue heat map.

FIG. 7B illustrates an example of a portable electronic device presenting a revenue heat map. Although FIG. 7B is described with reference to slot machines, this description is not intended to be limiting as the gaming heat map could depict video poker machines, gaming tables, roulette tables, keno games or other such games of chance and any combination of the proceeding. While the portable electronic device 752 is illustrated as a mobile phone, this illustration is not intended to be limiting as the portable electronic device 752 can be a personal media player, portable gaming device, netbook, tablet device, personal digital assistant or any other similar device.

The portable electronic device 752 may have a display 772 that can present the revenue heat map 770. The display 772 can be a liquid crystal display screen, organic light-emitting diode screen or any other type of display device found in portable electronic devices. The display 772 can have touch screen capabilities that may allow a user to manipulate the revenue heat map 770. The display 772 may have a touch screen View button 762 that may change views for the revenue heat map 770.

In one embodiment, changing views may entail switching revenue heat map types from line drawing maps to image maps. In another embodiment, changing views may entail switching to a first person perspective of the casino floor with information overlaid upon the visual representation. For example, the first person perspective of the casino floor may be represented by an augmented reality map. In yet another embodiment changing views may entail altering the scope of the presented casino floor.

The display 772 may have a touch screen Bookmark Slot Machine button 764 that may bookmark a slot machine of interest and its location to a casino host and players alike. In one embodiment, bookmarking will allow the casino host to recall a location of the slot machine of interest. In another embodiment, the casino host can bookmark a player of interest, such as a high value player who should be pampered, by associating the portable electronic device ID with the player status and value. The display 772 may have a touch screen "More Information" button 766 that displays additional information 754 for a particular slot machine (or a player). The additional information 754 may include location, amount of revenue, and duration of gaming session. The portable electronic device 752 may have physical buttons 768 or keys that can also allow the user to manipulate the revenue heat map 770. The physical buttons 768 can be a keyboard, number pad, arrow keys, and the like.

The revenue heat map 770 can include a casino map 774. The casino map 774 may be a scaled line drawing, photograph, or any other type of map. The casino map 774 may have labels for gaming machines, gaming tables, restaurants, bars, amenities, and other structures that appear within the casino map 774. In one embodiment, the casino map 774 may display a portion of the casino floor within a predefined radius around a location of the portable electronic device 752. The predefined radius may be defined by the casino host or the casino. In another embodiment, the casino map 774 may display a predefined zone that the location of the portable electronic device 752 is within. The casino map 774 may refresh and display a different portion of the casino floor based upon an updated location of the portable electronic device 752.

The revenue heat map 770 can have an indicator 776 denoting the location of the portable electronic device 752. The indicator 776 denoting the location of the portable electronic device 752 may be an icon, shape, symbol, picture, numeral, character, text or the like. The indicator 776 denoting the location of the portable electronic device 752 may include location data such as coordinates and orientation. Although the indicator 776 denoting the location of the portable electronic device 752 is illustrated at the center of the casino map 774, this illustration is not intended to be limiting as the indicator 776 may be anywhere within the casino map 774.

The revenue heat map 770 may identify at least one slot machine or player of interest to the casino host. The interest of the casino host may depend upon slot machine revenue, gaming session duration, player's data, and/or any other criteria of interest to the casino host. The identified at least one slot machine can be represented on the revenue heat map 770 by an icon, shape, symbol, picture, numeral, character, text or other such indicia.

In one embodiment, the identified at least one slot machine may be represented by a concentric ring symbol or contour lines. A slot machine represented by a two concentric ring symbol 758 may have generated little revenue over a long gaming session duration. A slot machine represented by a four concentric ring symbol 760 may have generated a large amount of revenue during a short gaming session duration. A slot machine represented by a three concentric ring symbol 756 may have generated a moderate amount of revenue, where the moderate amount of revenue is less than the slot machine represented by a four concentric ring 760 symbol and more than the slot machine represented by a two concentric ring symbol 758. Although the interest level of a particular identified slot machine to the casino host is illustrated here by the number of concentric rings, this illustration is not intended to be limiting. The degree of correlation may be represented not only by the number of indicia but also indicia size, indicia type, density of contour lines, color, letter grade, percentage, and the like.

While embodiments and applications of this invention have been shown and described, it would be apparent to those skilled in the art having the benefit of this disclosure that many more modifications than mentioned above are possible without departing from the inventive concepts herein.

What is claimed is:

1. A portable electronic device having an identifier associated with the user of the portable electronic device, comprising:

an indoor location identifying device configured to indicate a location of the portable electronic device in a casino environment;

a processor configured to receive real-time casino data from a server, the real-time casino data is associated with the location of the portable electronic device in the casino environment, at least one user-generated interest criteria search input, and data access privileges of the portable electronic device;

an authentication device configured to verify and authorize data access privileges of the portable electronic device's software application based on at least one digital signature associated with the software application and stored on the portable electronic device, the digital signature and the identifier transmitted to the server and compared to a stored digital signature and a stored identifier stored on the server for authentication;

a memory configured to store the real-time casino data and a casino data application; and a display configured to present the real-time casino data;

wherein the user-generated interest criteria search input is used by the server to generate the real-time casino data, the real-time casino data indicating relative gaming performance data for gaming machines located proximate to the indoor location of the portable electronic device.

2. The portable electronic device of claim 1, wherein the processor is configured to operate with the casino data application to receive real-time casino data associated with the location of the portable electronic device.

3. The portable electronic device of claim 1, wherein the processor is configured to interact with a casino data center to receive real-time casino data associated with the location of the portable electronic device.

4. The portable electronic device of claim 1, wherein the location is associated with a particular zone of a casino floor.

5. The portable electronic device of claim 1, wherein the real-time casino data is further prioritized according at least one sponsor preference or at least one player preference.

6. The portable electronic device of claim 1, wherein the real-time casino data is periodically reprioritized.

7. The portable electronic device of claim 1, further comprises at least one input device configured to allow navigation of the real-time casino data.

8. The portable electronic device of claim 1, wherein the location identifying device includes a location acquisition device configured to acquire a location data of the portable electronic device.

9. A portable electronic device, comprising:

an indoor location identifying device configured to indicate a location of the portable electronic device in a casino environment;

a processor configured to receive real-time casino data from a server, the real-time casino data is associated with the location of the portable electronic device in the casino environment, at least one user-generated interest criteria search input, and data access privileges of the portable electronic device;

an authentication device configured to receive and transmit authentication data to a casino data access server, the authentication data including at least one digital signature associated with an application software to be run on the portable electronic device;

a memory configured to store the real-time casino data and a casino data application; and a display configured to present the real-time casino data;

wherein the user-generated interest criteria search input is used by the server to generate the real-time casino data, the real-time casino data is prioritized according to at least one casino preference prior to being presented on the display of the portable electronic device.

10. A method for acquiring casino data on a portable electronic device comprising:

transmitting, by the portable electronic device, a location of the portable electronic device in a casino environment to at least one gaming device;

transmitting, by the portable electronic device, a digital signature associated with at least one casino data application;

transmitting an identifier associated with the portable electronic device;

authenticating, by an authentication server, the digital signature and the identifier; and determining if data access privileges to the casino data application operative to run on the portable electronic device is to be granted based at least in part on the digital signature;

receiving, at the portable electronic device, real-time casino data from a server if it is determined that data access privileges are to be granted, the real-time casino data is based on the location of the portable electronic device in the casino environment, at least one user-generated interest criteria search input, and the data access privileges of the portable electronic device; and presenting the real-time casino data on a display of the portable electronic device;

wherein the user-generated interest criteria search input is used by the server to generate the real-time casino data, the real-time casino data indicating relative gaming performance data for gaming devices in the casino environment that are located proximate to the location of the portable electronic device.

11. The method of claim 10 further comprising:

periodically updating the location of the portable electronic device, transmitting an updated location of the portable electronic device to the gaming device; and receiving updated real-time casino data based on the updated location and access privileges of the portable electronic device.

12. The method of claim 10 further comprising:

periodically reprioritizing the real-time casino data based on at least one criterion.

13. The method of claim 10 further comprising:

maintaining the portable electronic device's state and session data.

14. The method of claim 10 further comprising prioritizing the real-time casino data according to at least one sponsor preference or at least one player preference prior to the presenting of the real-time casino data on the display of the portable electronic device.

15. The method of claim 10 wherein the location is associated with a particular zone of the casino floor.

16. The method of claim 10 wherein the real-time casino data includes gaming machine data.

17. The method of claim 16 wherein the gaming machine data includes pay-in data collected during a predefined period of time, pay-out data collected during a predefined period of time, and/or game session duration data.

18. The method of claim 10 wherein the real-time casino data is associated with the predefined zone of the casino floor.

19. The method of claim 10 wherein the at least one of the gaming device is a slot machine.

20. The method of claim 10 wherein the at least one of the gaming device is a central gaming server.

21. A system for providing real-time casino data, comprising:

at least one portable electronic device including:

a location identifying device configured to indicate a location of the at least one portable electronic device in a casino environment;

a processor configured to receive real-time casino data from a server, the real-time casino data is based on the location of the at least one portable electronic device in the casino environment and gaming devices located in the casino environment that are proximate to the location of the at least one portable electronic device;

an authentication device configured to:

verify a digital signature associated with a casino data application to be run on the at least one portable electronic device, the digital signature compared to a stored digital signature on a server; and grant data access privileges to the casino data application operative to run on the at least one portable electronic device if the digital signature is verified;

a display configured to present the real-time casino data; and a gaming device configured to: (i) acquire the location of at least one portable electronic device in the casino environment, (ii) receive at least one user-generated interest criteria search input, wherein the user-generated interest criteria search input is used by the gaming device to generate the real-time casino data and (iii) transmit the real-time casino data to the at least one portable electronic device, the real-time casino data generated based on: (i) the location of the at least one portable electronic device; (ii) the data access privileges of the casino data application; (iii) and relative gaming performance data for gaming devices located proximate to the location of the at least one portable electronic device.

22. The system of claim 21 wherein the at least one gaming device is configured to periodically update the location of the at least one portable electronic device.

23. The system of claim 21, further comprising:

reprioritizing the real-time casino data based on at least one criterion.

24. The system of claim 21, further comprising:

storing the portable electronic device's state and session data.

25. The system of claim 21 wherein the at least one portable electronic device comprises a touch screen display configured to receive user inputs.

26. The system of claim 21 wherein the real-time casino data is further prioritized according to at least one sponsor preference or at least one player preference prior to being presented on the display of the portable electronic device.

27. The system of claim 21 wherein the real-time casino data is associated with a particular zone of the casino floor.

28. The system of claim 21 wherein the gaming device is a gaming server.

29. The system of claim 21 wherein the gaming device is a slot machine.

* * * * *